US007452316B2

(12) United States Patent
Cals et al.

(10) Patent No.: US 7,452,316 B2
(45) Date of Patent: Nov. 18, 2008

(54) PACKING PRODUCT AND APPARATUS AND METHOD FOR MANUFACTURING SAME

(75) Inventors: Hubertus Y. M. Cals, Maastricht (NL); Erwin R. J. Methorst, Neerbeek (NL); Koen Kuypers, Maastricht (NL); Pierre H. G. Kobben, Kerkrade (NL)

(73) Assignee: Ranpak Corp., Concord, OH (US)

( * ) Notice: Subject to any disclaimer, the term of this patent is extended or adjusted under 35 U.S.C. 154(b) by 924 days.

(21) Appl. No.: 10/303,660

(22) Filed: Nov. 25, 2002

(65) Prior Publication Data

US 2003/0145561 A1 Aug. 7, 2003

Related U.S. Application Data

(63) Continuation of application No. PCT/US01/16738, filed on May 24, 2001.

(60) Provisional application No. 60/206,684, filed on May 24, 2000.

(51) Int. Cl.

| | |
|---|---|
| ***B65D 85/30*** | (2006.01) |
| *B31B 7/02* | (2006.01) |
| *B31B 7/60* | (2006.01) |

(52) U.S. Cl. ..... 493/95; 493/84; 493/89; 206/591; 206/594

(58) Field of Classification Search ..... 426/166; 206/584, 591, 594; 493/84, 89, 93–95
See application file for complete search history.

(56) References Cited

U.S. PATENT DOCUMENTS 3,096,879 A 7/1963 Schumacher ..... 206/46

(Continued)

FOREIGN PATENT DOCUMENTS

DE 299 00 303 4/1999 ..... 25/10

(Continued)

OTHER PUBLICATIONS

International Search Report, PCT/US01/16738.

(Continued)

*Primary Examiner*—Rinaldi I. Rada
*Assistant Examiner*—Gloria R. Weeks
(74) *Attorney, Agent, or Firm*—Renner, Otto, Boisselle & Sklar, LLP

(57) ABSTRACT

A packing product and apparatus and method for manufacturing same are disclosed. The packing product includes at least one face sheet and at least one crumpled sheet pad attached to the face sheet. A package and method of packaging an article are also disclosed, the package including a container, one or more crumpled sheet pads positioned in the container, one or more face sheets positioned adjacent to the crumpled sheet pads, and an article positioned in the container in at least partial abutting relation to the one or more face sheets. The one or more face sheets may have portions that are folded to envelop the article. Also, the face sheet may include an opening having a pattern corresponding to a shape of the article. A pad producing apparatus includes a dunnage supply machine for supplying a strip of dunnage, a folding device for forming a fold line in and transverse to the strip of dunnage, and a capture chute for guiding and accumulating the folded strip of dunnage so that a first layer downstream of the fold line overlaps a second layer upstream of the fold line, thereby forming an accordion-like pad.

11 Claims, 15 Drawing Sheets

U.S. PATENT DOCUMENTS

| | | | | | |
|---|---|---|---|---|---|
| 3,982,057 | A | | 9/1976 | Briggs et al. | 428/73 |
| 4,109,040 | A | | 8/1978 | Ottaviano | 428/129 |
| 4,247,289 | A | | 1/1981 | McCabe | 493/386 |
| 4,286,006 | A | * | 8/1981 | Boelter | 428/182 |
| 4,382,106 | A | | 5/1983 | Royster | 428/40 |
| 4,720,321 | A | | 1/1988 | Smith | 156/549 |
| 4,773,534 | A | * | 9/1988 | DeHeras et al. | 206/709 |
| 4,793,123 | A | * | 12/1988 | Pharo | 53/449 |
| 4,937,131 | A | | 6/1990 | Baldacci et al. | 428/131 |
| 5,028,474 | A | * | 7/1991 | Czaplicki | 428/178 |
| 5,088,972 | A | * | 2/1992 | Parker | 493/352 |
| 5,102,036 | A | * | 4/1992 | Orr et al. | 229/89 |
| 5,173,352 | A | * | 12/1992 | Parker | 428/174 |
| 5,226,557 | A | * | 7/1993 | Nelson | 206/523 |
| 5,252,111 | A | | 10/1993 | Spencer et al. | 55/489 |
| 5,312,665 | A | | 5/1994 | Pratt et al. | 428/76 |
| 5,323,896 | A | * | 6/1994 | Jones | 206/223 |
| 5,465,530 | A | | 11/1995 | Santoiemmo | 428/402 |
| 5,466,211 | A | | 11/1995 | Komarek et al. | 493/354 |
| 5,511,667 | A | | 4/1996 | Carder | 206/586 |
| 5,538,775 | A | * | 7/1996 | Kawakami et al. | 428/76 |
| 5,538,778 | A | | 7/1996 | Hurwitz et al. | 428/136 |
| 5,540,972 | A | | 7/1996 | Jaegers et al. | 428/116 |
| 5,568,867 | A | | 10/1996 | Lencoski | 206/584 |
| 5,569,146 | A | | 10/1996 | Simmons | 493/352 |
| 5,571,067 | A | | 11/1996 | Ratzel | 493/30 |
| 5,643,167 | A | | 7/1997 | Simmons | 493/464 |
| 5,678,968 | A | | 10/1997 | Bourgeois et al. | 410/119 |
| 5,683,781 | A | | 11/1997 | Komarek et al. | 428/116 |
| 5,688,578 | A | * | 11/1997 | Goodrich | 428/136 |
| 5,712,020 | A | | 1/1998 | Parker | 428/182 |
| 5,733,403 | A | * | 3/1998 | Morley | 156/207 |
| 5,765,688 | A | * | 6/1998 | Bertram et al. | 206/523 |
| 5,791,483 | A | | 8/1998 | Simmons | 206/591 |
| 5,804,030 | A | | 9/1998 | Jaegers et al. | 156/510 |
| 5,882,767 | A | | 3/1999 | Simmons, Jr. | 428/179 |
| 5,959,171 | A | | 9/1999 | Hyttinen et al. | 800/2 |
| 5,989,176 | A | | 11/1999 | Ratzel et al. | 493/464 |
| 6,007,470 | A | | 12/1999 | Komarek et al. | 493/397 |
| 6,017,598 | A | * | 1/2000 | Kreischer et al. | 428/35.4 |
| 6,053,324 | A | | 4/2000 | Weder | 206/584 |
| 6,090,033 | A | | 7/2000 | Simmons, Jr. | 493/464 |
| 6,132,842 | A | | 10/2000 | Simmons, Jr. et al. | 428/132 |
| 6,168,847 | B1 | | 1/2001 | Murphy et al. | 428/126 |
| 6,202,390 | B1 | * | 3/2001 | Weder | 53/449 |
| 6,216,871 | B1 | * | 4/2001 | Bacques et al. | 206/497 |
| 6,254,945 | B1 | | 7/2001 | Simmons | 428/35.2 |
| 6,436,511 | B1 | | 8/2002 | Ratzel | 493/8 |
| 6,524,230 | B1 | | 2/2003 | Harding et al. | 428/152 |
| 6,718,733 | B2 | * | 4/2004 | Kilmartin | 53/397 |
| 2002/0002811 | A1 | * | 1/2002 | Weder et al. | 53/474 |

FOREIGN PATENT DOCUMENTS

| | | | |
|---|---|---|---|
| DE | 198 02 087 | 7/1999 | 5/50 |
| JP | 06255676 | 9/1994 | 81/4 |
| WO | 98/15472 | 4/1998 | 81/127 |
| WO | 99/32371 | 7/1999 | 81/107 |

OTHER PUBLICATIONS

Pactiv Packaging Hexacomb® H001PK, H007DCC and H007DCCC brochures, Pactiv Corporation 1996.

Pactiv Packaging Cushion Comb® webpage http://www.pactiv.com/cgi-bin/mkpage2.pl?/101/205/314/595.

* cited by examiner

PACKING PRODUCT AND APPARATUS AND METHOD FOR MANUFACTURING SAME

RELATED APPLICATION DATA

This application is a continuation of International Application No. PCT/US01/16738 filed May 24, 2001 and published in English, which claims the benefit under 35 USC 119(e) of earlier filed U.S. provisional application, Ser. No. 60/206,684, filed May 24, 2000, both of which are hereby incorporated herein by reference.

FIELD OF THE INVENTION

The invention relates generally to a packing product and more particularly to a packing product providing improved cushioning and durability characteristics.

BACKGROUND

Various types of packing products heretofore have been used to pack articles in containers for shipment. The packing products have been used to block and brace bulky articles in the containers, to cushion one or more sides of the articles, to wrap articles to provide protection on all sides thereof and/or to fill voids around a contained article.

Crumpled paper products have been used for these various purposes. A particularly desirable crumpled paper product is produced by crumpling one or more plies of sheet stock material, such as kraft paper. The sheet stock material is crumpled and folded upon itself to form lateral pillow portions with a central band therebetween. This crumpled paper product provides advantages such as flexibility whereby the pad can be folded, coiled or otherwise shaped into different configurations, and space efficiency wherein a single roll of stock material may be converted into multiple crumpled paper products.

Sometimes a packing product with greater structural stability and/or load spreading capability is needed for packing particular articles. For example, it is known to pack articles in containers using a packing product having a sandwich construction consisting of one or more pieces of stiff or soft plastic foam between cardboard face sheets. One or both cardboard face sheets may be provided with a die cut opening for capture of the article being packed. One drawback of such type of packing product is its deleterious effect on our environment; the plastic foam is not biodegradable and thus is not environmentally friendly and safe.

Another type of packing product is a honeycomb panel. The honeycomb panel includes a honeycomb core sandwiched between a pair of face sheets. The core, which may be made from kraft paper, has cells with vertically extending walls that are adhesively secured at their ends to the face sheets so that the cell walls are restrained against lateral movement. The honeycomb panel provides advantages such as load distribution capability wherein the face sheets act to distribute a load over a large number of the cells of the honeycomb core. One variation of the honeycomb panel includes a honeycomb core that has a portion of the cell walls compressively deformed in order to make the honeycomb panel more resilient. However, such resiliency exists only over a modest degree of compression of the honeycomb panel, after which the honeycomb panel becomes quite stiff.

Thus, the inventors appreciated that a need exists for a packing product with greater structural stability and/or load spreading capability, while still affording a wide range of resiliency as may be desirable for many packing applications.

SUMMARY OF THE INVENTION

The present invention provides a packing product that has structural stability and/or load spreading capability, while still affording a wide range of resiliency as may be desirable for many packing applications. The packing product is a synergistic combination of a crumpled sheet material and one or more face sheets that enables the provision of packaging attributes heretofore not attainable by existing packing products.

According to an aspect of the invention, there is provided a packing product comprising at least one face sheet and at least one crumpled sheet pad attached to the face sheet.

In a preferred embodiment, the at least one crumpled sheet pad is randomly crumpled. Also, preferably a crumpled surface of the at least one crumpled sheet pad is attached to the at least one face sheet.

In an embodiment, the crumpled sheet pad includes at least one ply of a continuous sheet material folded on itself and crumpled. The at least one crumpled sheet pad may be made of paper and preferably has a natural resilience. The at least one face sheet preferably includes a panel made of paper such as, for example, cardboard or corrugated cardboard.

In an embodiment, the at least one crumpled sheet pad is attached to the at least one face sheet by bonding, and preferably by an adhesive bonding. In another embodiment, the at least one crumpled sheet pad is attached to the at least one face sheet by stapling.

In yet another embodiment, the at least one crumpled sheet pad in transverse cross section has a width greater than its height, and the at least one crumpled sheet pad has the width thereof disposed parallel to the at least one face sheet. In another embodiment the width is disposed perpendicular to the at least one face sheet.

In still another embodiment, the at least one crumpled sheet pad includes a plurality of crumpled sheet pads.

In an embodiment, the at least one face sheet includes first and second face sheets and the at least one crumpled sheet pad is disposed therebetween and attached to the first and second face sheets. As is preferred, the first and second face sheets are substantially parallel to each other.

In an embodiment, the at least one face sheet and at least one crumpled sheet pad form a base wall portion, and the crumpled sheet pad extends beyond the at least one face sheet to form at least one hinge portion and at least one flap wall portion connected to the hinge portion, the hinge portion enabling the at least one flap wall portion to be folded over and into abutting or overlapping relation with the base wall portion. In a preferred embodiment, the at least one face sheet includes at least one upper face sheet and a lower face sheet and the at least one crumpled sheet pad is sandwiched therebetween, the lower face sheet corresponding in length to the at least one crumpled sheet pad and including a fold line to enable the lower face sheet to bend along the hinge portion of the at least one crumpled sheet pad. Still more preferably, the at least one upper face sheet includes two upper face sheets spaced apart by a gap, a portion of the at least one crumpled sheet spanning the gap to form the hinge portion. The upper face sheets may include one or more openings sized to receive one or more articles therein.

In another embodiment, the at least one face sheet includes an outer face sheet and a plurality of inner face sheets, and the at least one crumpled sheet pad includes a plurality of crumpled sheet pads sandwiched between and attached to the outer face sheet and the respective plurality of inner face sheets. The outer face sheet may form a plurality of outer face sheet walls to which the respective plurality of crumpled sheet pads are attached. In a preferred embodiment, the plurality of crumpled sheet pads are spaced apart from each other, and still more preferably the plurality of inner face sheets are spaced apart from each other. Also, the size of at least one inner face sheet may be different than the size of the other inner face sheets.

In an embodiment the outer face sheet is folded along fold lines to form a wrap around packing product having a plurality of outer face sheet walls to which the respective plurality of crumpled sheet pads are attached. In an embodiment, the wrap around packing product is placed in a container to maintain the plurality of outer face sheet walls in their folded states. At least one of the pads may provide a cushion characteristic different from that of another of the pads. In another embodiment, opposing edges of the plurality of outer face sheet walls are connected together by one or more tabs to maintain the plurality of outer face sheet walls in their folded states.

In an embodiment, the at least one crumpled sheet pad is coiled.

In still another embodiment, the at least one face sheet includes a base wall portion and at least one flap wall portion extending from a respective side of the base wall portion and weakened areas defining fold lines between the flap wall portion and the base wall portion. The base wall portion and at least one flap wall portion are folded to define an inside and outside of the packing product and, in one embodiment the at least one crumpled sheet pad faces the inside and, in another embodiment the at least one crumpled sheet pad faces the outside.

The at least one face sheet may include an opening for receiving an article therein. The opening may have a pattern corresponding to a shape of the article.

In another embodiment, the at least one crumpled sheet pad is folded upon itself, and in still another embodiment, folded upon itself in an accordion like manner.

According to another aspect of the invention, there is provided a method of packaging an article, wherein the method includes the step of using a packing product to cushion the article, wherein the packing product includes at least one face sheet and at least one crumpled sheet pad attached to the face sheet. In an embodiment, the article and packing product are placed into a container. Alternatively, the packing product may surround the article.

According to another aspect of the invention there is provided a method of making a packing product including the step of attaching at least one crumpled sheet pad to at least one face sheet.

According to still another aspect of the invention, there is provided a method of packaging an article, including the steps of positioning at least one crumpled sheet pad in a container, positioning a face sheet in the container adjacent to the crumpled sheet pad or pads, and positioning the article adjacent to the face sheet.

In an embodiment, the crumpled sheet pad or pads are attached to the face sheet. In another embodiment, the face sheet is provided with an opening having a pattern corresponding to a shape of the article.

According to another aspect of the invention, there is provided a package including a container, one or more crumpled sheet pads positioned in the container adjacent to one or more walls of the container, one or more face sheets positioned in the container adjacent to the crumpled sheet pad or pads, the one or more face sheets being attached to the respective one or more crumpled sheet pads, and an article positioned in the container in at least partial abutting relation to the one or more face sheets.

According to still another aspect of the invention, there is provided a method of packaging an article, including the steps of providing a face sheet having a multi-sided base and respective flaps extending from the sides of the base, positioning the crumpled sheet pad adjacent to an inside surface of the base and an opposing two of the flaps, positioning the article on the crumpled sheet pad, inwardly folding the opposing two flaps and the crumpled sheet pad toward the article so as to envelop the article by the crumpled sheet pad, inwardly folding the other flaps toward the article, and securing the flaps in their folded states.

In an embodiment, the crumpled sheet pad is attached to the inside surface of the base and the opposing two of the flaps. As is preferred, opposing ends of the two flaps are folded into abutting or overlapping relation. In an embodiment, the other flaps are folded to overlie the opposing ends of the two flaps. In another embodiment, opposing ends of the two flaps are folded to form opposing side walls and ends of the other flaps are folded to form other side walls at an angle relative to the opposing side walls formed by the two flaps. In still another embodiment, opposing ends of the two flaps are folded to form a top panel at an angle relative to the opposing side walls and other side walls formed by the two flaps and other flaps.

According to another aspect of the invention, there is provided a method of packaging an article, including the steps of positioning a crumpled sheet pad in juxtaposition with a face sheet, positioning an article on the crumpled sheet pad, inwardly folding opposing ends of the face sheet and crumpled sheet pad toward the article so as to envelop the article by the crumpled sheet pad, and securing opposing edges of the face sheet together to maintain the face sheet and crumpled sheet pad in their folded states.

In a preferred embodiment, the crumpled sheet pad is attached to the face sheet. In an embodiment, the opposing ends of the face sheet are folded along a fold line located midway between the opposing ends. The opposing edges of the face sheet may be bent towards one another. As is preferred, the perimeter of the crumpled sheet pad is within the perimeter of the face sheet.

According to still another aspect of the invention, there is provided a method of packaging an article including attaching a plurality of crumpled sheet pads to a respective plurality of outer face sheet walls, attaching a plurality of inner face sheets to the respective plurality of crumpled sheet pads, positioning the article on at least one of the inner face sheets, folding the plurality of outer face sheet walls inwardly towards the article so that the inner face sheets align with the respective sides of the article, and securing the plurality of outer face sheet walls to maintain the outer face sheet walls in their folded states.

In an embodiment, opposing edges of the plurality of outer face sheet walls are connected together by one or more tabs. In another embodiment, the folding of the outer face sheet walls forms a wrap around packing product which may be placed into a container.

According to another aspect of the invention, there is provided a pad producing apparatus, including a dunnage supply machine supplying a strip of dunnage, a folding device for forming a fold line in and transverse to the strip of dunnage, and a capture chute for guiding and accumulating the folded strip of dunnage so that a first layer downstream of the fold line overlaps in parallel relation a second layer upstream of the fold line, thereby forming an accordion-like pad.

In an embodiment, the dunnage supply machine includes a cushioning conversion machine which converts sheet stock material into the strip of dunnage. Also, the pad producing apparatus may include a controller for synchronizing operation of the dunnage supply machine, the folding device, and the capture chute.

In an embodiment, the folding device includes opposed squeeze members on opposite sides of the path of travel of the strip of dunnage. The folding device may also include a swivelling chute with opposite side walls on which the respective opposed squeeze members are disposed. In an embodiment, the squeeze members are movable relatively towards one another (i.e., one squeeze member may be moved towards the opposed squeeze member, or both squeeze members may be moved towards one another) to create the fold line in the strip of dunnage. In yet another embodiment, the swivelling chute is moveable about a pivot axis to direct the strip of dunnage in a desired location in the capture chute to effect the guiding and accumulating of the folded strip of dunnage.

In still another embodiment, the capture chute includes a first pair of opposed walls spaced apart to accommodate a width dimension of the strip of dunnage. The first pair of opposed walls may be made moveable relative to one another to increase or decrease the spacing therebetween to facilitate accommodation of different width pads. The capture chute may also include a second pair of opposed walls spaced apart to accommodate a length dimension of the first and second layers of the strip of dunnage. The second pair of opposed walls may be made moveable relative to one another to increase or decrease the spacing therebetween to facilitate accommodation of different length pads.

According to yet another aspect of the invention, there is provided a method of producing an accordion-like pad, including the steps of using a dunnage supply machine for supplying a strip of dunnage, using a folding device for forming a fold line in and transverse to the strip of dunnage, and using a capture chute for guiding and accumulating the folded strip of dunnage such that a first layer downstream of the fold line overlaps in parallel relation a second layer upstream of the fold line, thereby forming an accordion-like pad.

In an embodiment, the dunnage supply machine includes a cushioning conversion machine which converts sheet stock material into the strip of dunnage. Also, a controller may be used to synchronize operation of the dunnage supply machine, the folding device, and the capture chute.

In an embodiment, the folding device includes opposed squeeze members on opposite sides of a path of travel of the strip of dunnage, and the step of using the folding device includes moving the squeeze members relatively towards one another to create the fold line in the strip of dunnage. In another embodiment, the folding device includes a swivelling chute, and the step of using the folding device includes moving the swivelling chute about a pivot axis to direct the strip of dunnage in a desired location in the capture chute to effect the guiding and accumulating of the folded strip of dunnage.

In still another embodiment, the capture chute includes a first pair of opposed walls spaced apart to accommodate a width dimension of the strip of dunnage, and the step of using the capture chute includes guiding the strip of dunnage between the opposed walls. In an embodiment, the first pair of opposed walls may be moved relative to one another to increase or decrease the spacing therebetween to facilitate accommodation of different width pads. The capture chute may also, or alternatively, include a second pair of opposed walls spaced apart to accommodate a length dimension of the first and second layers of the strip of dunnage, the strip of dunnage being guided between the opposed walls. In an embodiment, the second pair of opposed walls may be moved relative to one another to increase or decrease the spacing therebetween to facilitate accommodation of different length pads.

In an embodiment, using the capture device includes using the capture device to resist movement of the first layer downstream of the fold line as the dunnage supply machine pushes the upstream layer towards the downstream layer, whereby the pushing by the dunnage supply machine bends the upstream layer relative to the downstream layer about the fold line which, in turn, urges together the upstream and downstream layers.

In an embodiment, the steps of using the folding device to fold the strip of dunnage and using the capture device to accumulate layers of the folded strip of dunnage are successively repeated until a desired amount of layers forming the accordion-like pad are obtained.

The foregoing and other features of the invention are hereinafter more fully described and particularly pointed out in the claims, the following description and the annexed drawings setting forth in detail illustrative embodiments of the invention, such being indicative, however, of but a few of the various ways in which the principles of the invention may be employed.

DETAILED DESCRIPTION

Figure 1:
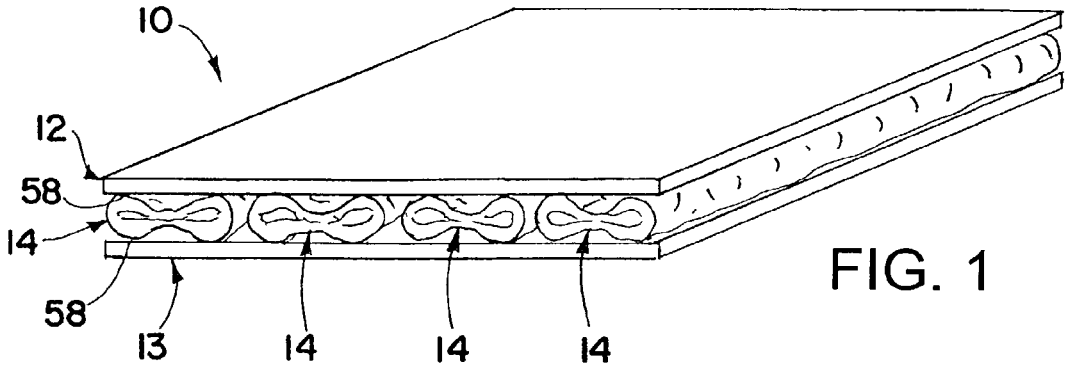
FIG. 1 is a perspective view of a packing product in accordance with the present invention.

Referring now in detail to the drawings, FIG. 1 shows a packing product 10 according to the present invention. The packing product 10 includes a pair of face sheets 12 and 13 and at least one crumpled sheet pad 14 disposed between and attached to the face sheets 12 and 13. As shown in FIG. 1, the crumpled sheet pad or pads 14 are disposed side by side with their upper sides attached to the underside of the upper face sheet 12 and their lower sides attached to the top of the lower face sheet 13. The crumpled sheet pad or pads are formed by crumpling one or more plies of sheet material that preferably has a natural resiliency, such as 30 to 75 pound kraft paper. Preferably a crumpled surface of the crumpled sheet pad is attached to the face sheet.

Figure 2:
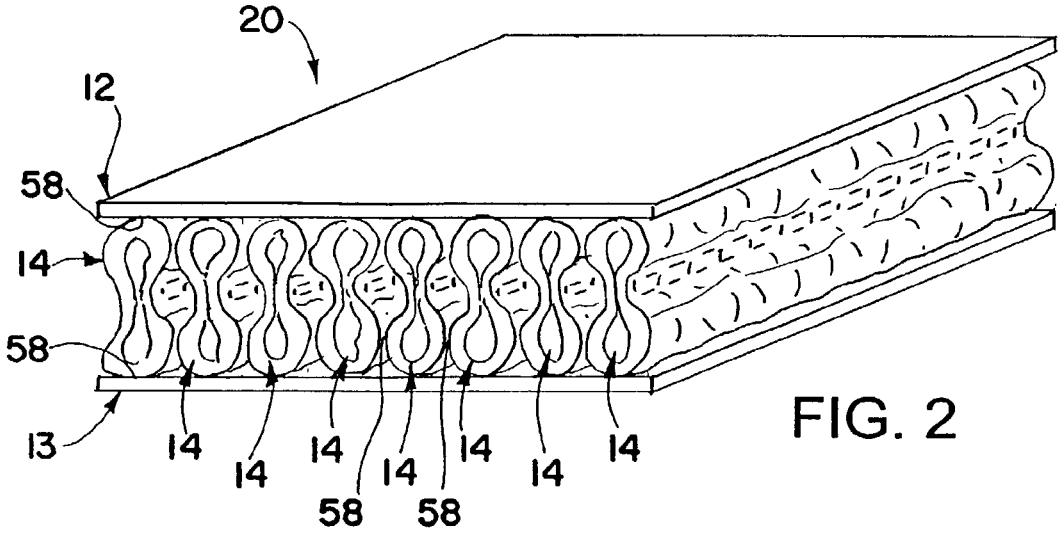
FIG. 2 is a perspective view of another packing product in accordance with the present invention.
Figure 3:
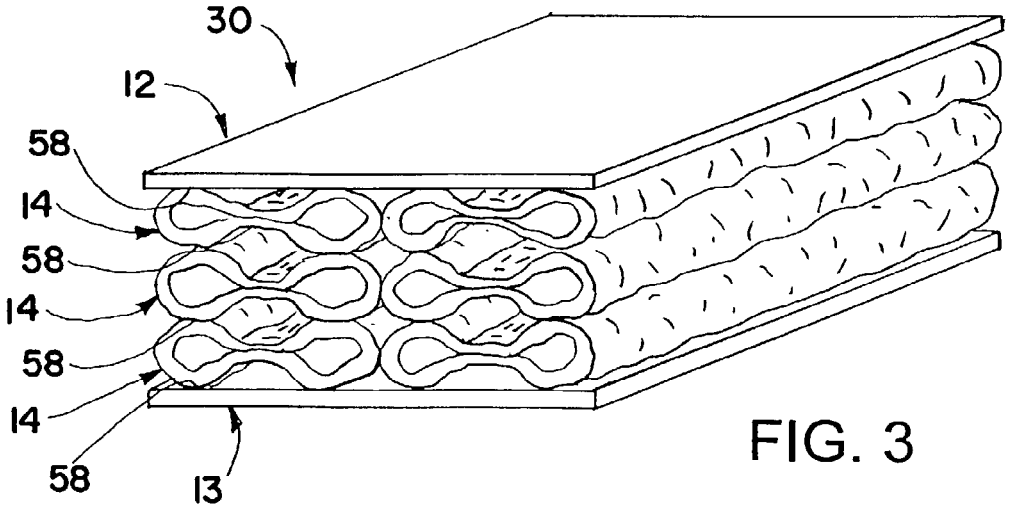
FIG. 3 is a perspective view of still another packing product in accordance with the present invention.

As shown for example in FIGS. 2 and 3, other arrangements of the crumpled sheet pad or pads relative to the face sheets are also contemplated by the present invention. FIG. 2 shows a packing product 20 wherein the crumpled sheet pads 14 are disposed on edge (i.e., with their width dimension perpendicular to the face sheets 12 and 13) and have the lateral edges thereof attached to the face sheets 12 and 13. FIG. 3 shows a packing product 30 wherein the crumpled sheet pads 14 are disposed in two columns, stacked one on top of the other, and sandwiched between the two face sheets 12 and 13 (i.e., with their width dimension parallel to the face sheets 12 and 13). The crumpled sheet pads 14 adjacent to the face sheets 12 and 13 are attached thereto and adjacent crumpled sheet pads 14 are attached to each other.

The packing products 10, 20 and 30 shown in FIGS. 1-3 each include a pair of face sheets 12 and 13. This sandwich-type packing product is more versatile than a single face sheet packing product as it can be positioned into a container in two different ways. For example, the packing product 10 may be positioned into a container so that the lower face sheet 13 is inserted therein before the upper face sheet 12 or, alternatively, so that the upper face sheet 12 is inserted therein before the lower face sheet 13. However, the present invention also contemplates a packing product having one or more face sheets. For example, a packing product (not shown) may comprise a single face sheet and a crumpled sheet pad attached to the face sheet. Such a packing product would be suitable in an application wherein the packing product is positioned in a container with the crumpled sheet pad abutting a wall of the container, in which case the wall, in effect, may act as a second face sheet.

The face sheets 12 and 13 preferably act as load distributing members and for this purpose the face sheets comprise a stiff material such as cardboard or corrugated cardboard. Although less preferred, the face sheets 12 and 13 could be made of non-paper based materials such as thin metal sheets of aluminum or steel, or lighter materials such as plywood or plastic. The face sheets 12 and 13 are preferably planar although materials conforming to the shape of the article to be packaged, or the container in which the article is to be packaged, are also contemplated as being within the scope of the present invention.

Figure 4:
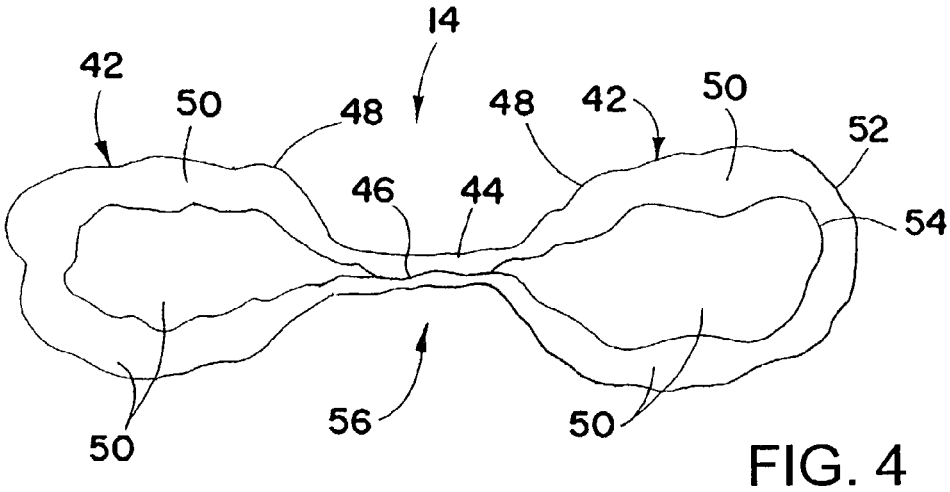
FIG. 4 is an end view of an exemplary crumpled sheet pad used in forming the packing products of the present invention.

The crumpled sheet pad or pads 14 are made of one or more plies of sheet material preferably having a natural resiliency and being biodegradable and recyclable, such as kraft paper. FIG. 4 shows an exemplary crumpled sheet pad 14, which comprises a pair of pillow portions 42 formed by crumpled overlapping portions of sheet stock material 48. The pillow portions 42 define a plurality of random voids 50 which render the crumpled sheet pad 14 less dense than the uncrumpled sheet stock material 48 and provide a resilient springiness thereto. The FIG. 4 crumpled sheet pad 14 is composed of two plies 52 and 54 of sheet stock material 48, although one, two, three or more plies are contemplated as being within the scope of the present invention. The crumpled sheet pad may be of any desired shape and produced with any desired process.

In the exemplary crumpled sheet pad 14, a central band 56 separates the pillow portions 42. The central band 56 acts as a connecting portion to connect folded-over, or overlapping portions 44 and 46 of sheet stock material 48 and thereby prevent the same from unfolding. The connecting may be by deforming the sheet stock material 48 as by coining the overlapping layers in the central band, cutting tabs and slots therein and interconnecting the same, attaching adjacent layers thereof, for example, by bonding, taping, gluing or stapling, and/or by other methods.

The crumpled sheet pad 14 preferably is formed by a cushioning conversion machine of the type disclosed, for example, in U.S. Pat. Nos. 4,103,040; 4,937,131; 5,403,259; 5,568,867; 5,573,491; 5,643,167; 5,712,020; 5,791,483; 5,882,767, all of which are owned by the assignee of the present invention and are hereby incorporated herein by reference. Of course, other crumpled sheet pads which include resilient crumpled portions may also be used in the packing product, and such pads are contemplated as falling within the scope of the present invention.

As mentioned above, the face sheet 12 of the packing product 10 preferably provides a load transferring function wherein a load acting thereon is distributed across the adjacently positioned crumpled sheet pad or pads 14. The face sheet 12 can distribute an otherwise concentrated load over a wider surface area thereby distributing the load over a larger portion of the crumpled sheet pad or pads 14. For example, a load acting on the center of the face sheet 12 may be distributed across the several crumpled sheet pads 14.

The crumpled sheet pad or pads 14 may be attached to the face sheets 12 and 13 and/or to each other, for example, by bonding, gluing, taping, stapling, or cutting tabs and slots therein and interconnecting the same. Preferably the attaching is effected by an adhesive commonly denoted by reference numeral 58 in FIGS. 1-3, with a hot melt adhesive being preferred. The adhesive 58 maintains the face sheet 12 and crumpled sheet pad or pads 14 in assembled relationship and further prevents slippage therebetween. The adhesive bond between the pad(s) and face sheet(s) may also assist in distributing the load exerted on the face sheets 12 and 13 by directing the load along the path defined by the bond 58 to different portions of the crumpled sheet pads 14.

The packing product 10 of the present invention provides supportive strength and durability by making optimal use of the cushioning capabilities of the crumpled sheet pad 14. The face sheet 12 adds nominal weight and size to the overall packing product 10, characterizing the packing product 10 with lightweight and compact properties and therefore making it desirable for material handling and protective packaging applications.

It will be appreciated that the face sheet (or sheets) and the crumpled sheet pad (or pads) provide flexibility in forming a packing product tailored to the specific requirements of a packaging application. Among other things, the stiffness characteristic of the packing product can be varied by selection of the orientation of the pads relative to the face sheets, the number of pads used, the density of the individual pads, the collective density of the pads, the size of the pads, etc. For instance, the pads can be spaced apart to provide a low spring constant or closely packed together to provide a high spring constant.

Figure 5:
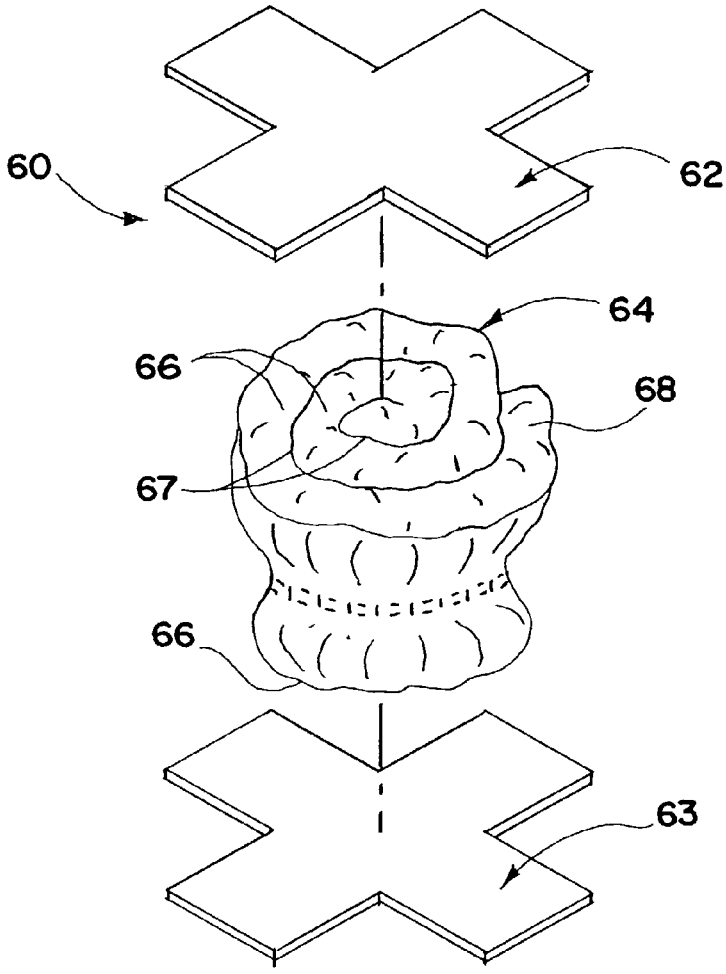
FIG. 5 is an exploded perspective view of still another packing product in accordance with the present invention, the packing product including a crumpled sheet pad in a coiled configuration.

The flexibility afforded by the present invention is further illustrated by the packing product shown in FIG. 5. The packing product 60 includes a pair of face sheets 62 and 63 and a coiled crumpled sheet pad 64 disposed therebetween. The lateral edges 66 of the crumpled sheet pad 64 are attached to the face sheets 62 and 63.

The face sheets 62 and 63 may have a cross shape as illustrated although other shapes may also be suitable, for example, round or rectangular. The face sheets 62 and 63 extend to the outer diameter of the coiled crumpled sheet pad 64 and therefore bridge the overlapping layers that make up the pad 64. The resiliency of the crumpled sheet pad 64 can be controllably varied by varying the density of the winding of the pad 64. For example, a less resilient (stiffer) pad can be obtained by tightly winding the overlapping layers that form the pad and a more resilient pad can be obtained by loosely winding and/or forming gaps in between the overlapping layers of the pad. In a loosely wound pad, a load acting on the face sheets 62 and 63 in a location in which there is no crumpled sheet pad 64 directly adjacent thereto (i.e., the bridged portion) will be supported by the neighboring layers of the pad 64.

The face sheets 62 and 63 also prevent an article to be packaged from settling into any gaps 67 between overlapping portions of the coiled crumpled sheet pad 64. By attaching the face sheets 62 and 63 to the lateral edge portions 66, the face sheets 62 and 63 assist in maintaining the coiled configuration of the crumpled sheet pad 64 by preventing the coiled pad and particularly the trailing end 68 thereof from unwinding or otherwise separating from remaining portions of the coiled pad 64.

Figure 6:
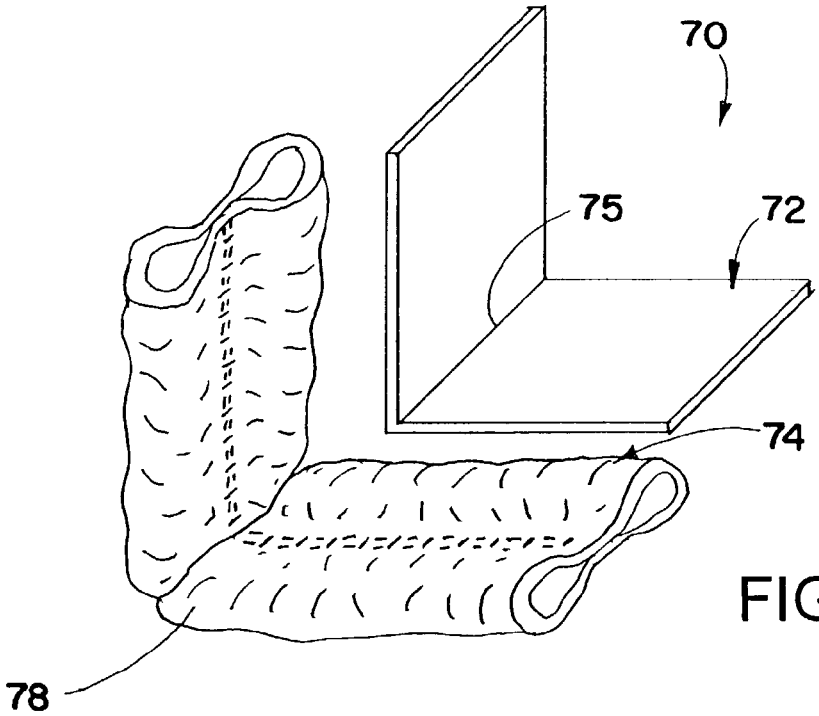
FIG. 6 is an exploded perspective view of another packing product in accordance with the present invention.

In FIG. 6 there is shown in exploded view a packing product 70 for providing cushioning and/or bracing in a corner or other angular configuration of a container into which the packing product is to be placed. The packing product includes a face sheet 72 and a crumpled sheet pad 74 attached thereto. The face sheet 72 is folded or bent along a weakened area corresponding to fold line 75, respectively, into a generally L-shape configuration. In its pre-folded state the crumpled sheet pad 74 preferably is longitudinally compressed at a corner portion 78 to an extent greater than the adjacent portions of the pad. Thus, when the pad is folded the thickness of the pad 74 at the corner portion 78 will expand longitudinally and back to the same degree of longitudinal compression as the portions of the pad extending along the sides of the packing product 70. Such longitudinal crumpling may be achieved by manually pushing the end portions of the pad towards one another prior to attaching to the face sheet.

Figure 7:
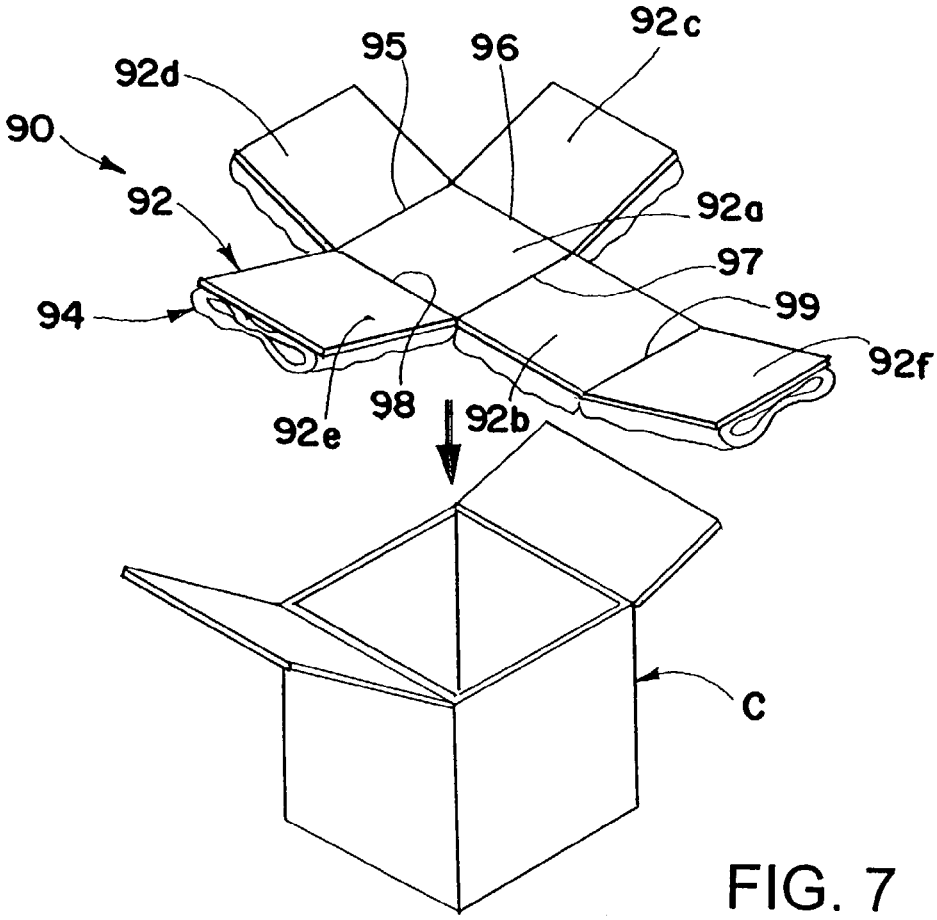
FIG. 7 is a perspective view of a further packing product in accordance with the present invention and a container into which the packing product is to be inserted.

FIG. 7 shows yet another embodiment of a packing product 90 in accordance with the present invention and a container C into which the packing product 90 is to be positioned. The packing product 90 includes a face sheet 92 and one or more crumpled sheet pads 94. The face sheet has a base wall portion 92*a* and flap wall portions 92*b-e* extending from respective sides of the base wall portion. One or more of the flap wall portions may have extending therefrom a further flap wall portion 92*f*. The base and flap wall portions preferably are defined by weakened areas corresponding to fold lines 94, 95, 96, 97 and 98 whereat the face sheet may be easily folded to form an enclosure around a product to be packed. The face sheet 92 may be formed, for example, by cutting the face sheet from a blank of stiff sheet material (for example, cardboard or corrugated cardboard), or by way of further example from two strips of stiff sheet material that then are positioned transverse to one another and overlapped at the base wall portion 92*a*.

The base and flap wall portions 92*a-f* have crumpled sheet pads attached to the outer surfaces thereof. The pads 94 may be arranged, for example, by crossing a first pad with a second pad that underly (or overly) one another at the base wall portion 92*a*, in which case there would be two layers (or doubling up) of the pads 94 at the base wall portion. Alternatively and by way of further example, one long pad may be attached to the base and linearly disposed flap wall portions while separate pads are attached to the other flap wall portions to eliminate doubling up of the pads. The packing product 90 may be sized to correspond to the interior dimensions of a rectangular box shape container, for example the container C, so that when positioned therein the packing product 90 abuts each of the six sides of the container C and provides load distributed cushioning around an article (not shown) contained by the packing product 90.

Figure 8:
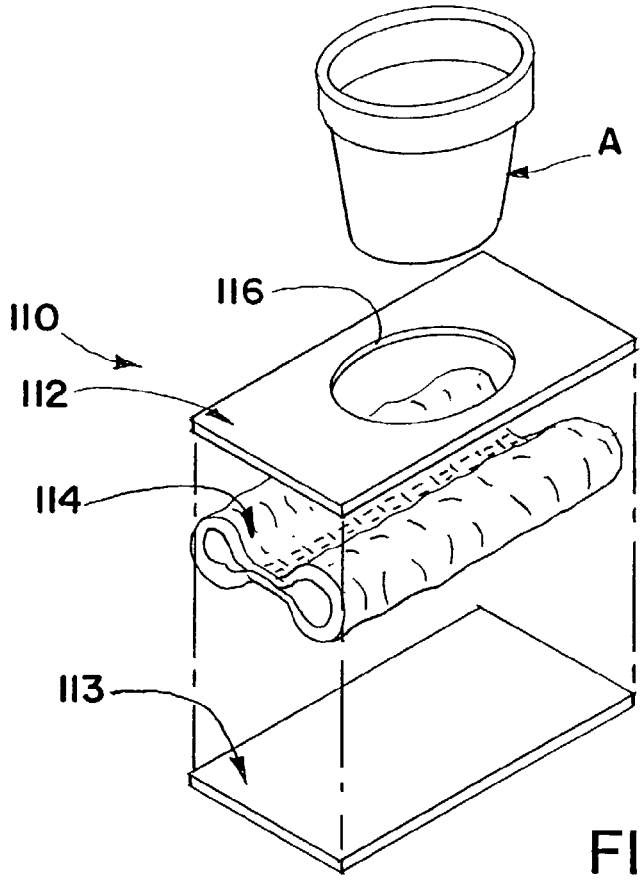
FIG. 8 is an exploded perspective view of still another packing product in accordance with the present invention, the packing product being shown with an article to be packaged.

The packing product of the present invention may also be sized according to the size and dimensions of the article to be packaged. For example, FIG. 8 shows a packing product 110 adapted to receive an article A having a generally circular bottom. The packing product 110 includes a pair of face sheets 112 and 113 and one or more crumpled sheet pads 114 (one shown in FIG. 8). The upper face sheet 112 has an opening 116 therein which preferably has a pattern corresponding to a cross-section of the article A so that at least a portion of the perimeter of the opening 116 engages the article A. The opening 116 may be die cut, manually cut or otherwise formed as desired.

In the packing product 110 of FIG. 8, a load exerted by the article A on the face sheet 112 is supported at least partially by the perimeter of the opening 116 thereof. The face sheet 112, in turn, transfers the load to the portions of the face sheet 112 surrounding the opening 116 and to the adjacently positioned crumpled sheet pad 114. The perimeter of the opening 116 also substantially inhibits lateral movement of the article A by providing lateral support thereto. Of course, additional packing products may also be provided as desired to surround the article A.

Figure 9:
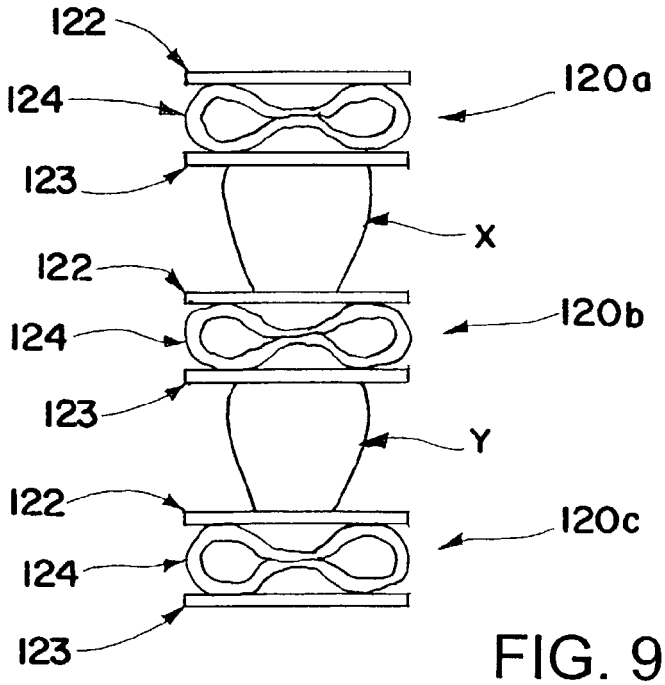
FIG. 9 is an elevational view of a stacked arrangement of packing products and articles in accordance with the present invention.

The packing product of the present invention is also particularly useful in applications requiring stacking of articles one on top of the other. As shown for example in FIG. 9, three packing products 120*a*, 120*b*, 120*c* are alternately positioned relative to two articles X and Y. Here, the tops and bottoms of the respective articles X and Y are supported by the face sheets 122, 123 of the packing products 120*a*, 120*b*, 120*c* which, in turn, distribute the loads acting thereon to the adjacently positioned crumpled sheet pads 124 therebetween. Thus, the centrally located packing product 120*b* provides cushioning between the articles X and Y. If desired, face sheets 122 could also be provided with openings, such as 116 in FIG. 8, for laterally stabilizing articles X and Y.

Figure 10:
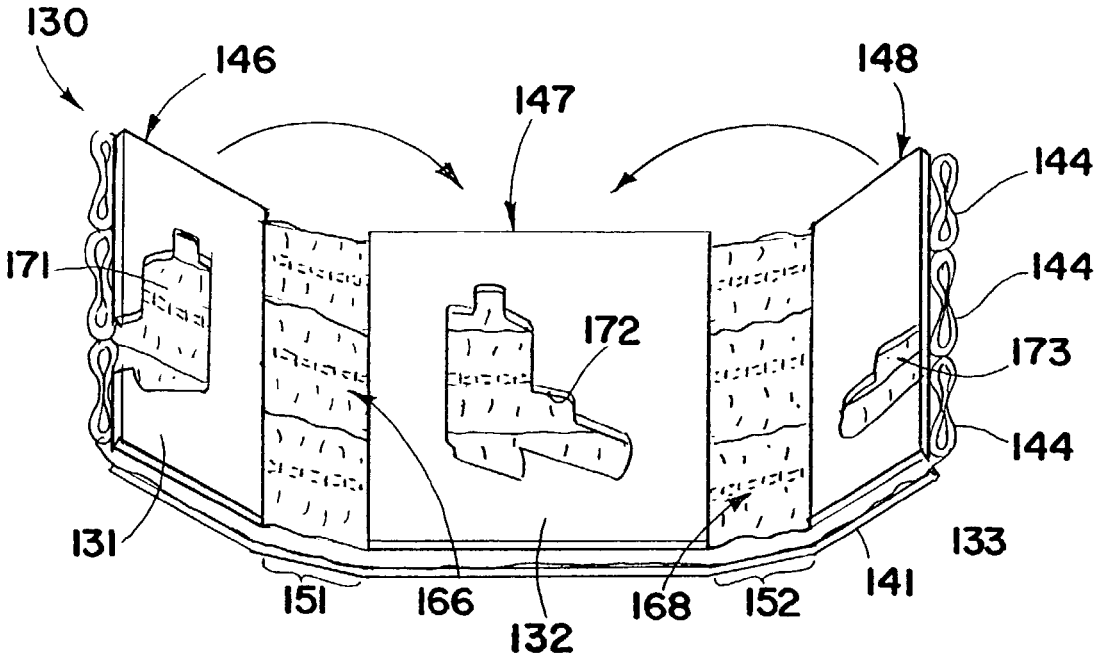
FIG. 10 is a top perspective view of another packing product in accordance with the present invention.
Figure 11:
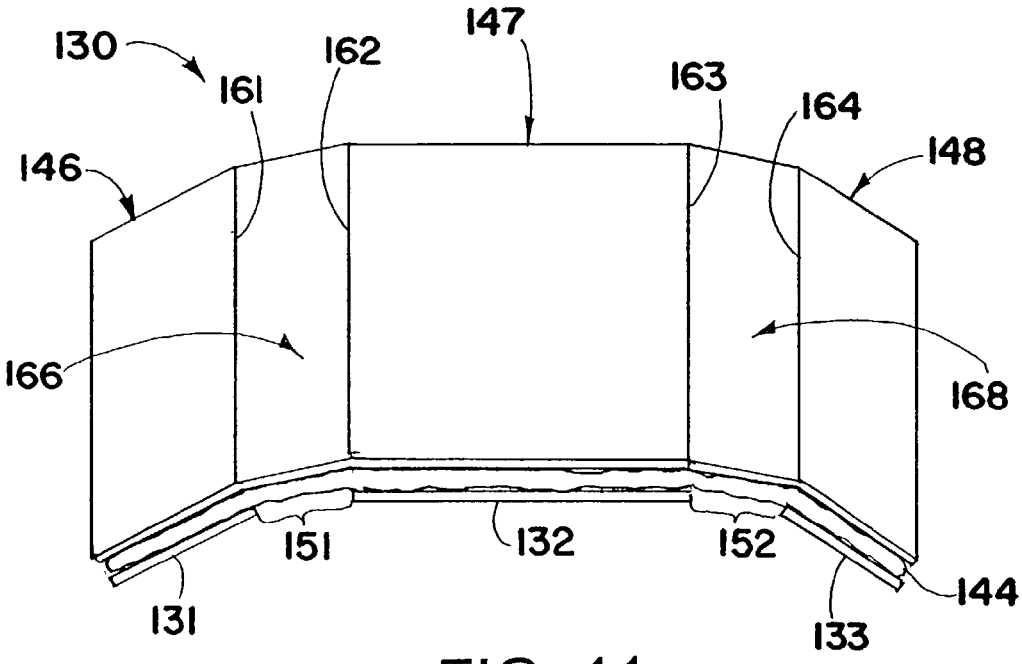
FIG. 11 is a bottom perspective view of the packing product of FIG. 10.

FIGS. 10 and 11 show yet another embodiment of a packing product 130 in accordance with the present invention. The packing product 130 includes a set of spaced first, second and third upper face sheets 131,132 and 133, respectively, an elongated lower face sheet 141, and three elongated side by side crumpled sheet pads 144 sandwiched between the upper face sheets 131, 132 and 133 and the lower face sheet 141. Together the face sheets 131-133 and 141 and the crumpled sheet pads 144 form a base wall portion 147 and a pair of flap wall portions 146 and 148 which can be folded inwardly (in the direction of the dashed lines) towards and into abutting (or overlapping) relation with the base wall portion 147.

The spaced upper face sheets 131, 132 and 133 are attached to the top of the crumpled sheet pads 144 and the lower face sheet 141 is attached to the underside of the crumpled sheet pads 144. The attachment between the face sheets 131-133 and 141 and the pads 144 maintains the juxtaposition of the pads 141. The upper face sheets 131, 132 and 133 are longitudinally spaced apart by gaps 151 and 152 which extend transverse to the pads 144. The lower face sheet 141, as shown in FIG. 11, includes transverse weakened areas corresponding to fold lines 161, 162, 163 and 164 which are spaced apart to coincide with the transverse sides of the longitudinal gaps 151 and 152, that is, the fold lines 161, 162, 163, and 164 are located in respective planes which extend from the transverse borders of the gaps 151 and 152 and perpendicularly through the pads 144. The fold lines 161, 162, 163 and 164 of the lower face sheet 144 and the portions of the pads 144 spanning the gaps 151 and 152 together form hinge portions 166 and 168 which enable the flap wall portions 146 and 148 to be folded as afore described. If desired, the portions of the lower face sheet corresponding to the hinge portions can be removed, or not provided in the first instance.

Referring again to FIG. 10, the upper face sheet 132 may have an opening or a cut line 172 sized to receive an article (for example, a glue gun) therein and the upper face sheets 131 and 133 may have respective openings or cut lines 171 and 173 which, when the flap wall portions 146 and 148 are folded inwardly, correspond to the opening 172 of the face sheet 132 and/or juxtaposed portions of the article being packed. As can be appreciated by the foregoing, when an article is placed into the opening 172 and the flap wall portions 146 and 148 are folded over and onto the base portion 147 so that the perimeters of the areas defined by 171 and 173 engage the article, the packing product 130 essentially encases the article on all sides thereof. In this way, the upper face sheets 131, 132 and 133 inhibit or substantially prevent lateral shifting of the article and the crumpled sheet pads 144 provide cushioning to absorb and dampen loads which may act on the article.

Figure 12:
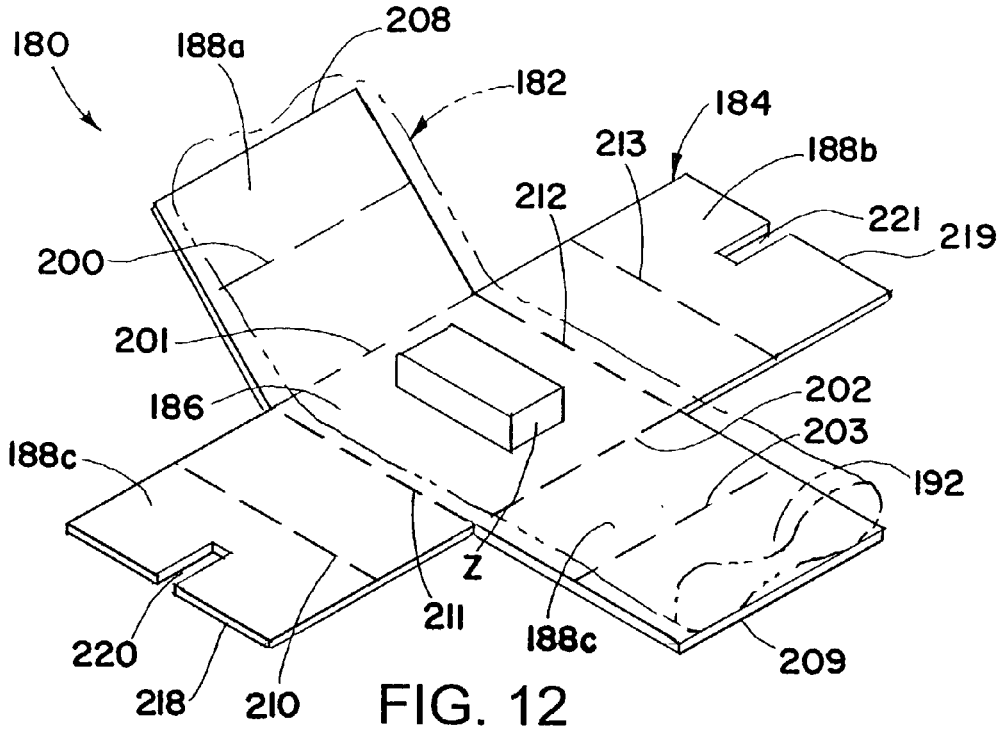
FIG. 12 is a perspective view of a further packing product in accordance with the present invention, showing an article to be packaged therein.

In FIG. 12 there is shown another embodiment of a packing product 180 in accordance with the present invention. The packing product 180 includes one or more crumpled sheet pads 182 (only one shown in phantom) and a face sheet 184. The face sheet 184 has a multi-sided base 186 and respective flaps 188*a-d* extending from the sides of the base 186. The face sheet 184 may be formed, for example, by cutting the face sheet from a blank of stiff sheet material (for example, cardboard or corrugated cardboard), or by way of further example from two strips of stiff sheet material that then are positioned transverse to one another and overlapped at the base wall portion 186.

The crumpled sheet pad 182 is attached to an inside surface 192 of the base 186 and two of the flaps, for example 188*a* and 188*c* in the illustrated embodiment. An article Z to be packaged is positioned on the crumpled sheet pad 182, for example as shown in FIG. 12, and the two opposing flaps 188*a* and 188*c* and the crumpled sheet pad 182 are together inwardly folded toward the article Z along weakened areas corresponding to fold lines 200, 201, 202 and 203 so that edges 208 and 209 of the respective two flaps 188*a* and 188*c* are in abutting relation. In so doing, the crumpled sheet pad 182 surrounds or envelops the article Z on all sides thereof. The other flaps, 188*b* and 188*d* in the illustrated embodiment, are then inwardly folded toward the article Z along weakened areas corresponding to fold lines 210, 211, 212 and 213. Edges 218 and 219 are then engaged in at least partial overlapping relation via slots 220 and 221. The illustrated exemplary packing product 180 is a six sided rectangular shape container with the article Z contained therein. In this embodiment it will be appreciated that the face sheet 184 of the packing product 180 may function both as a load distributing member by distributing loads acting thereon to the adjacently positioned one or more crumpled sheet pads 182 and as a container by containing, or enveloping the article Z on all sides thereof.

Figure 14:
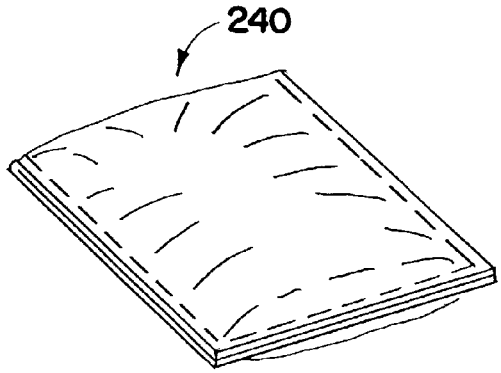
FIG. 14 is a perspective view of the FIG. 13 packing product in its assembled state enclosing the article.
Figure 13:
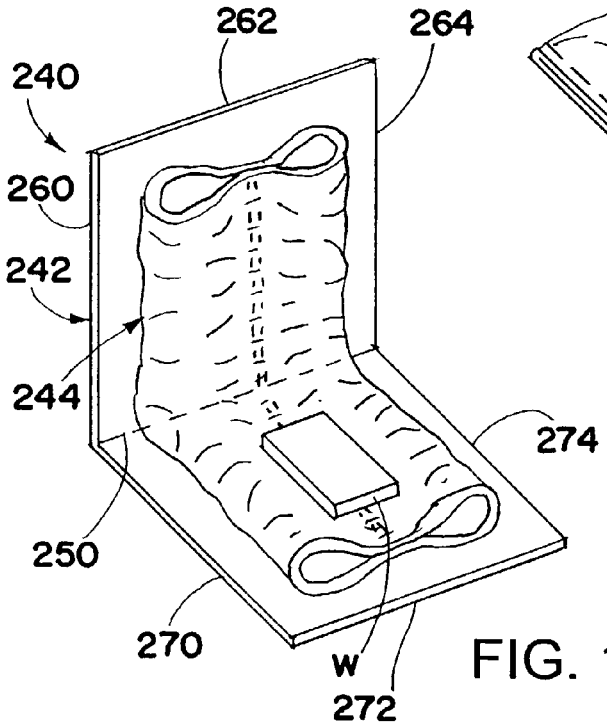
FIG. 13 is a perspective view of a still further packing product in accordance with the present invention, showing an article to be packaged therein.

FIG. 13 shows yet another embodiment of a packing product 240 in accordance with the present invention wherein an article W is to be packaged. The packing product 240 includes a face sheet 242 and one or more crumpled sheet pads 244 (only one pad shown) attached thereto. The face sheet is folded along a weakened area corresponding to fold line 250. In the packing product's 240 folded state, edges or edge portions 260, 262 and 264 of the face sheet 242 are preferably butted against their respective opposing edges or edge portions 270, 272 and 274 and, as shown in FIG. 14, the resulting packing product 240 takes the shape of a pillow. The edges or edge portions 260, 262 and 264 are preferably attached, for example with adhesive tape, glue, stapling or stitching, to the opposing edges or edge portions 270, 272 and 274 to complete the packing product 240. To facilitate connection of the edges 260, 262 and 264 to edges 270, 272 and 274, the face sheet 242 may have a slightly larger peripheral dimension than that of the crumpled sheet pad 244. In addition, the crumpled sheet pad 244 may be slightly compressed as needed when the face sheet 242 and crumpled sheet pad 244 are folded.

Figure 15:
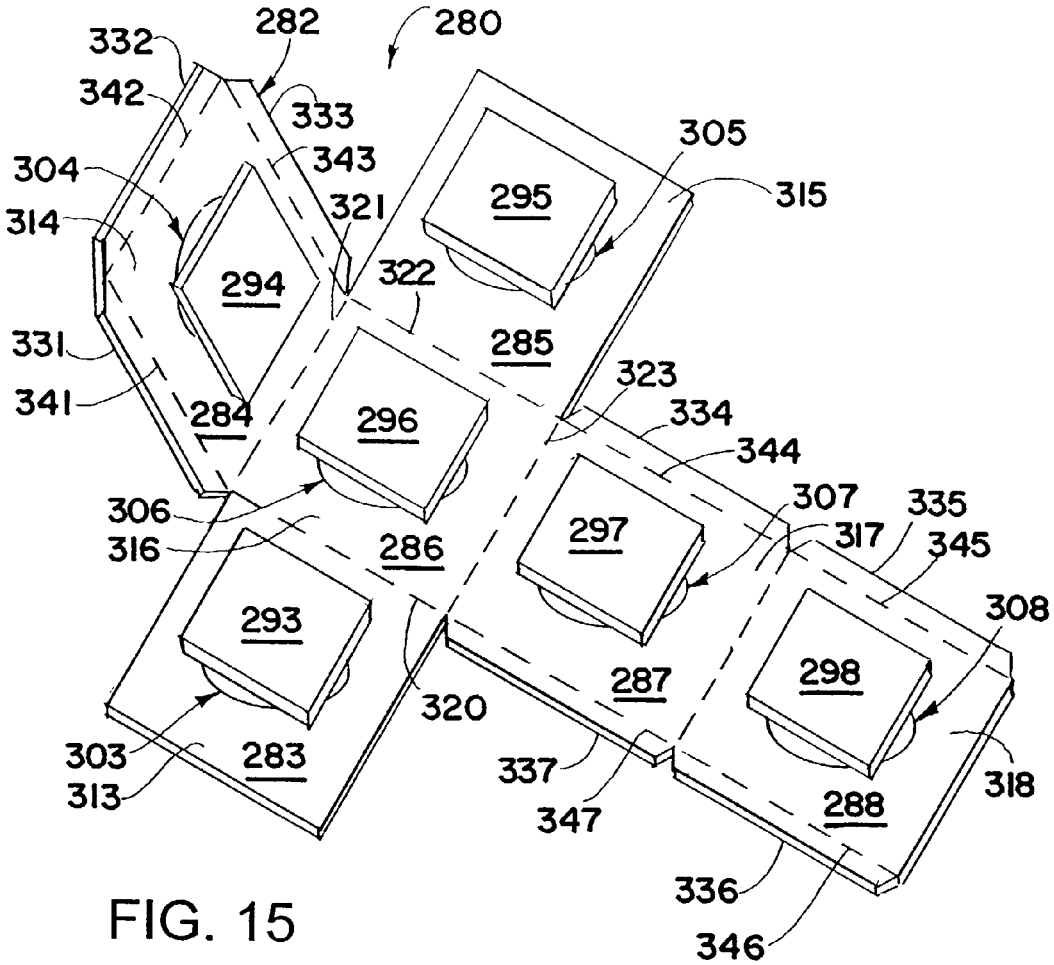
FIG. 15 is a perspective view of still another packing product in accordance with the present invention.

FIG. 15 shows yet another embodiment of a packing product 280 in accordance with the present invention. The packing product 280 includes an outer face sheet 282 having a plurality of face sheet walls 283, 284, 285, 286, 287 and 288, a plurality of respective inner face sheets 293, 294, 295, 296, 297 and 298, and a plurality of respective crumpled sheet pads 303, 304, 305, 306, 307 and 308 disposed between the respective face sheet walls 283, 284, 285, 286, 287 and 288 of the outer face sheet 282 and the respective plurality of inner face sheets 293, 294, 295, 296, 297 and 298. The illustrated exemplary outer face sheet 282 may be formed by, for example, a manner similar to that of the embodiments shown in FIGS. 7 and 12; that is, by cutting the face sheet from a blank of stiff sheet material or from two strips of sheet material that are then positioned transverse to one another and overlapped at, for example, face sheet wall 286. The exemplary packing product 280 includes six face sheet walls 283, 284, 285, 286, 287 and 288, and six corresponding inner face sheets 293, 294, 295, 296, 297 and 298 and crumpled sheet pads 303, 304, 305, 306, 307, 308. Of course, alternative packing products may have more or fewer face sheet walls, inner face sheets and crumpled sheet pads, and such alternatives are contemplated as falling within the scope of the presently claimed invention.

In the exemplary packing product 280, the crumpled sheet pads 303, 304, 305, 306, 307 and 308 are attached to an inside surface 313, 314, 315, 316, 317 and 318 of the respective face sheet walls 283, 284, 285, 286, 287 and 288. The crumpled sheet pads 303, 304, 305, 306, 307, and 308 may be coiled or straight as afore described. The inner face sheets 293, 294, 295, 296, 297 and 298 are attached to each of the respective crumpled sheet pads 303, 304, 305, 306, 307 and 308.

Figure 16:
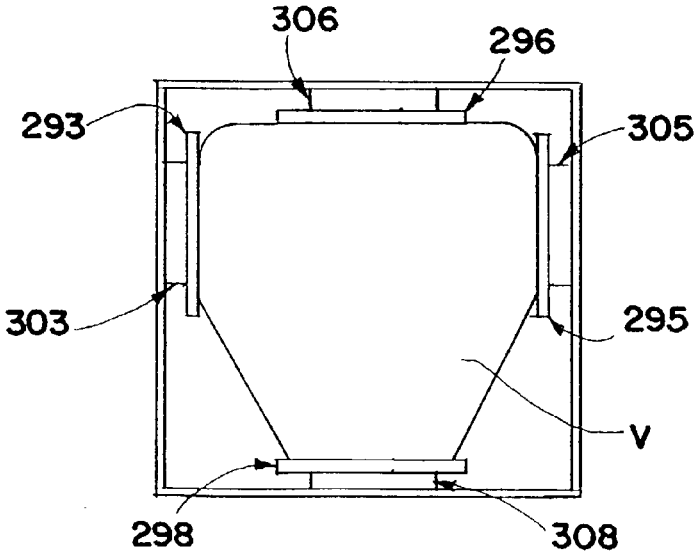
FIG. 16 is a top plan view of the packing product of FIG. 15 in its assembled state with a top face sheet thereof removed for viewing an article packaged therein.

It will be appreciated that the crumpled sheet pads 303, 304, 305, 306, 307 and 308 and the corresponding inner face sheets 293, 294, 295, 296, 297 and 298 may be positioned relative to the respective face sheet walls 283, 284, 285, 286, 287 and 288 to achieve location-specific cushioning with respect to the particular article to be packaged. For example, if the article V to be packaged (FIG. 16) is a computer monitor or television receiver having a front portion thereof relatively wider than the rear portion thereof, then the inner face sheets 293, 294, 295 and 297 and corresponding crumpled sheet pads 303, 304, 305 and 307 may be positioned (i.e., offset) towards the front portion of the packing product 280.

In packaging the article V, the article V is positioned on, for example, the inner face sheet 297 (i.e., the base portion) and then the outer face sheet 282 and more particularly the inner face sheets 293, 294, 295, 296 and 298 and the respective crumpled sheet pads 303, 304, 305, 306 and 308, are inwardly folded toward the article V along weakened areas corresponding to fold lines 320, 321, 322, 323 and 324. In so doing, each inner face sheet 293, 294, 295, 296, 297 and 298 and corresponding crumpled sheet pad 303, 304, 305, 306, 307 and 308 align relative to a respective wall of the article V to be packaged. It will be appreciated that each inner face sheet 293, 294, 295, 296, 297 and 298 functions substantially independently of other inner face sheets 293, 294, 295, 296, 297 and 298 as a load distributing member distributing loads acting thereon to its respective corresponding crumpled sheet pad 303, 304, 305, 306, 307 and 308. Together, each inner face sheet 293, 294, 295, 296, 297 and 298 and corresponding crumpled sheet pad 303, 304, 305, 306, 307 and 308 essentially function as a damper substantially independently of the other face sheets with corresponding crumpled sheet pads.

Once the face sheet walls 283, 284, 285, 286, 287 and 288 have been folded around the article V, the face sheet walls 283, 284, 285, 286, 287 and 288 may be attached together at their adjacent edges. In the illustrated exemplary embodiment, the outer face sheet 282 includes tabs 331, 332, 333, 334, 335, 336 and 337 which are folded along respective weakened areas corresponding to fold lines 341, 342, 343, 344, 345, 346 and 347 and attached to their respective interfacing face sheet wall. Thus, in the illustrated exemplary embodiment tabs 331 and 337 are attached to face sheet wall 283, tabs 333 and 334 are attached to face sheet wall 285, tab 332 is attached to face sheet wall 288, tab 335 is attached to face sheet wall 285 and tab 336 is attached to face sheet wall 283. The attaching may be done by gluing, adhesive tape, stapling or other attaching means.

Figure 17:
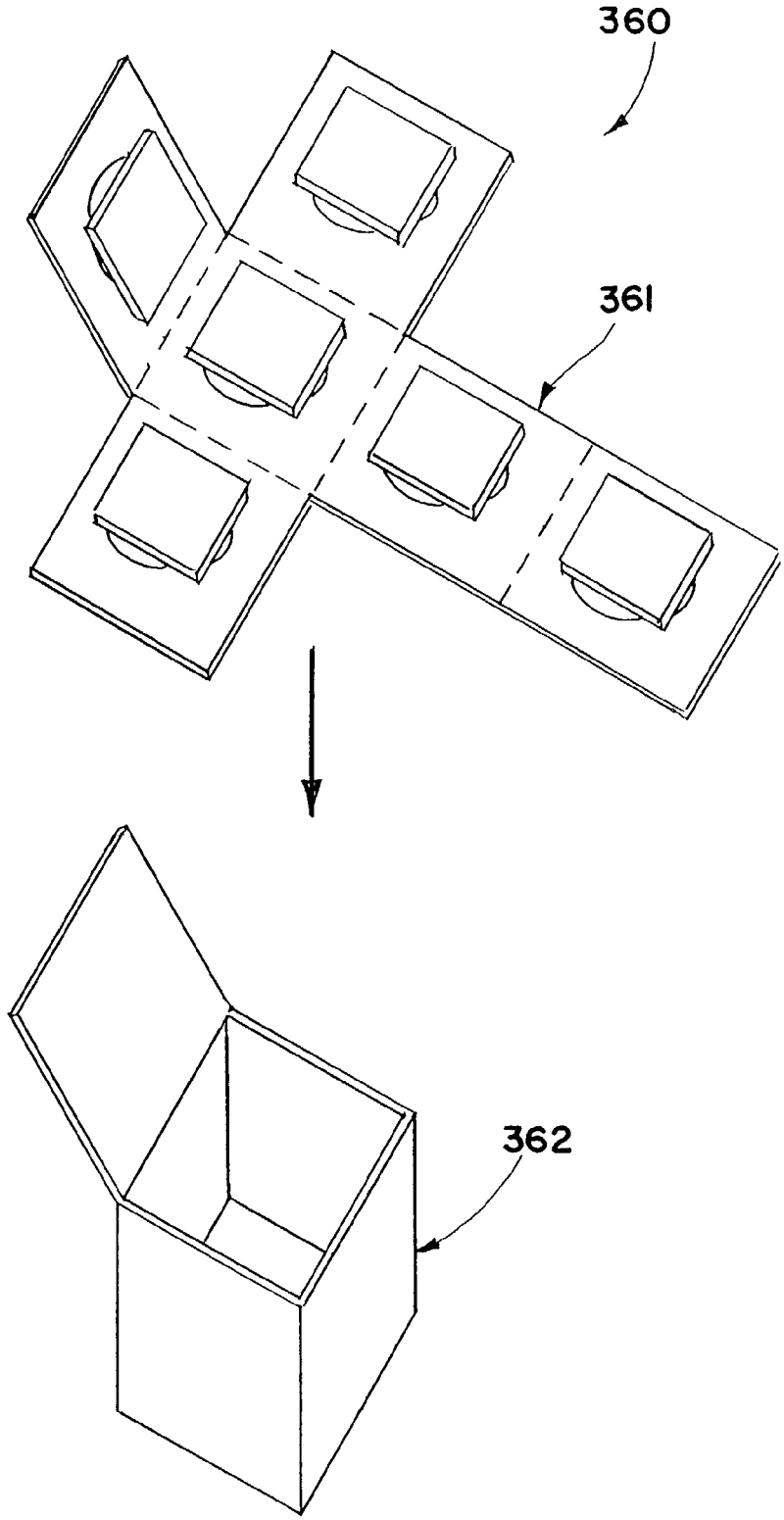
FIG. 17 is a perspective view of yet another packing product in accordance with the present invention.

Alternatively, as shown in FIG. 17, a packing product 360, when assembled, may comprise a wrap around packing product 361 and a container 362 of larger size and into which the wrap around packing product 361 and article V (FIG. 16) are placed. The wrap around packing product 361 may be similar to the aforedescribed packing product 280 sans the tabs 331, 332, 333, 334, 335, 336 and 337. Such an arrangement provides additional strength (compared to the packing product 280) by providing additional stiffness at the outer surface thereof. Moreover, placing the wrap around packing product 361 into another container 362 simplifies assembly since the container 362 functions to maintain the face sheet walls of the enveloping packing product in their folded state, thus eliminating the need for the aforedescribed tabs and the attaching thereof.

The packing products 280 and 360 may be particularly useful in applications requiring packaging of oblong or non-uniform shape articles since the inner face sheets and corresponding crumpled sheet pads may be positioned as desired to fill the voids between the walls of the article to be packaged and the respective face sheet walls of the outer face sheet or to otherwise cushion the article. Thus, for a relatively larger void, a relatively larger crumpled sheet pad can be used and for a relatively smaller void, a relatively smaller crumpled sheet pad can be used.

Figure 18:
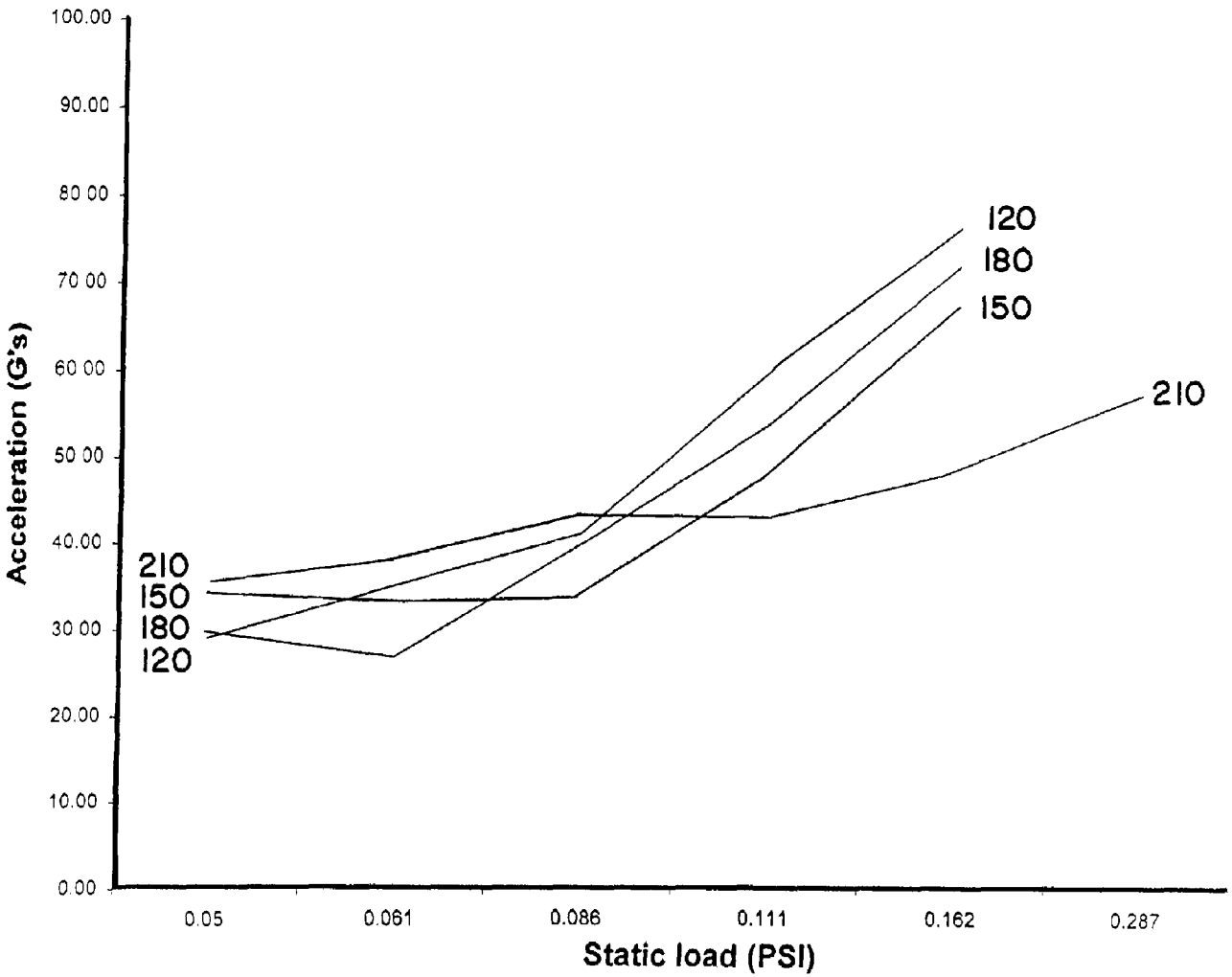
FIG. 18 is a graph of test results of a packing product constructed in accordance with the present invention.
Figure 19:
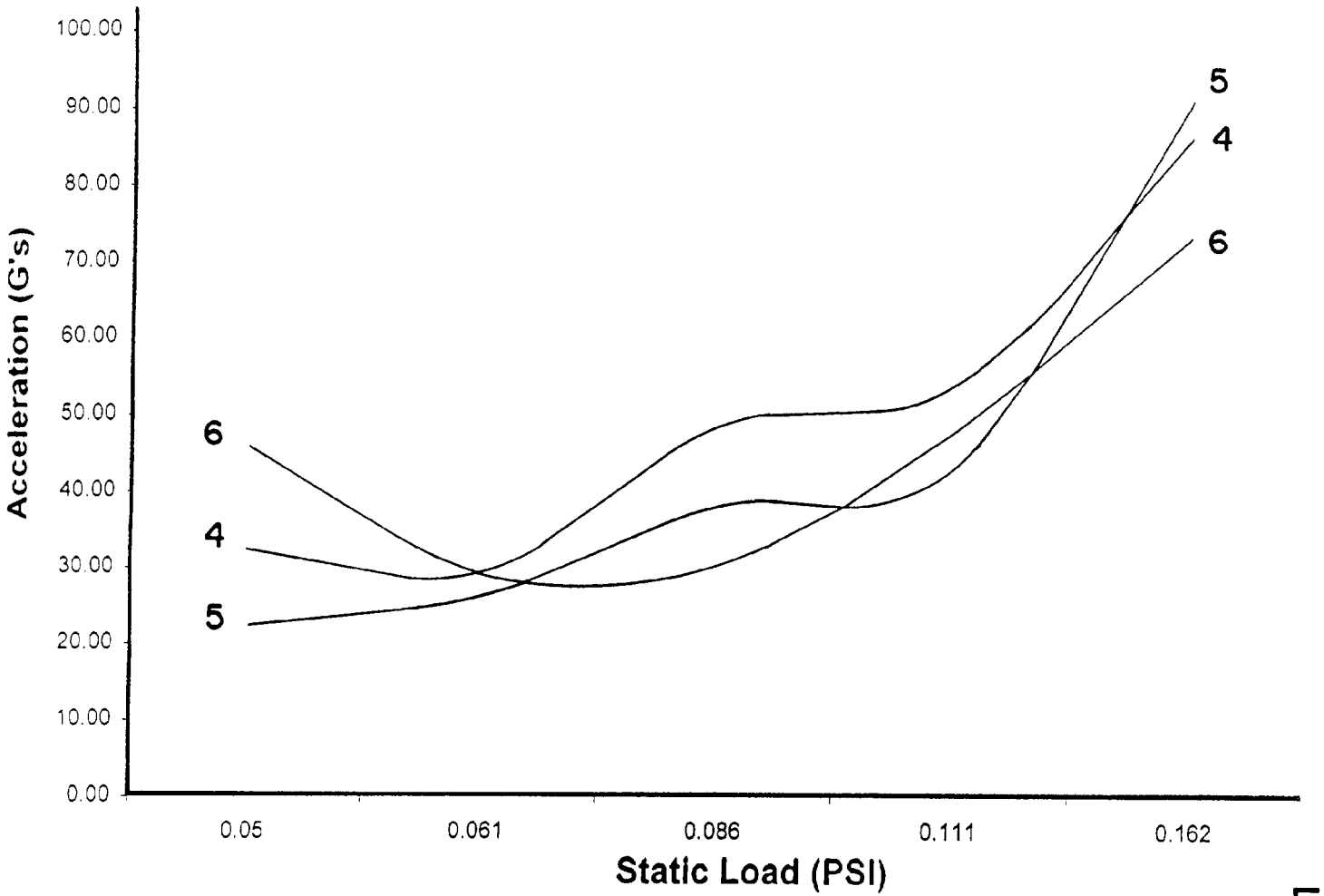
FIG. 19 is a graph of test results of a packing product constructed in accordance with the present invention.
Figure 20:
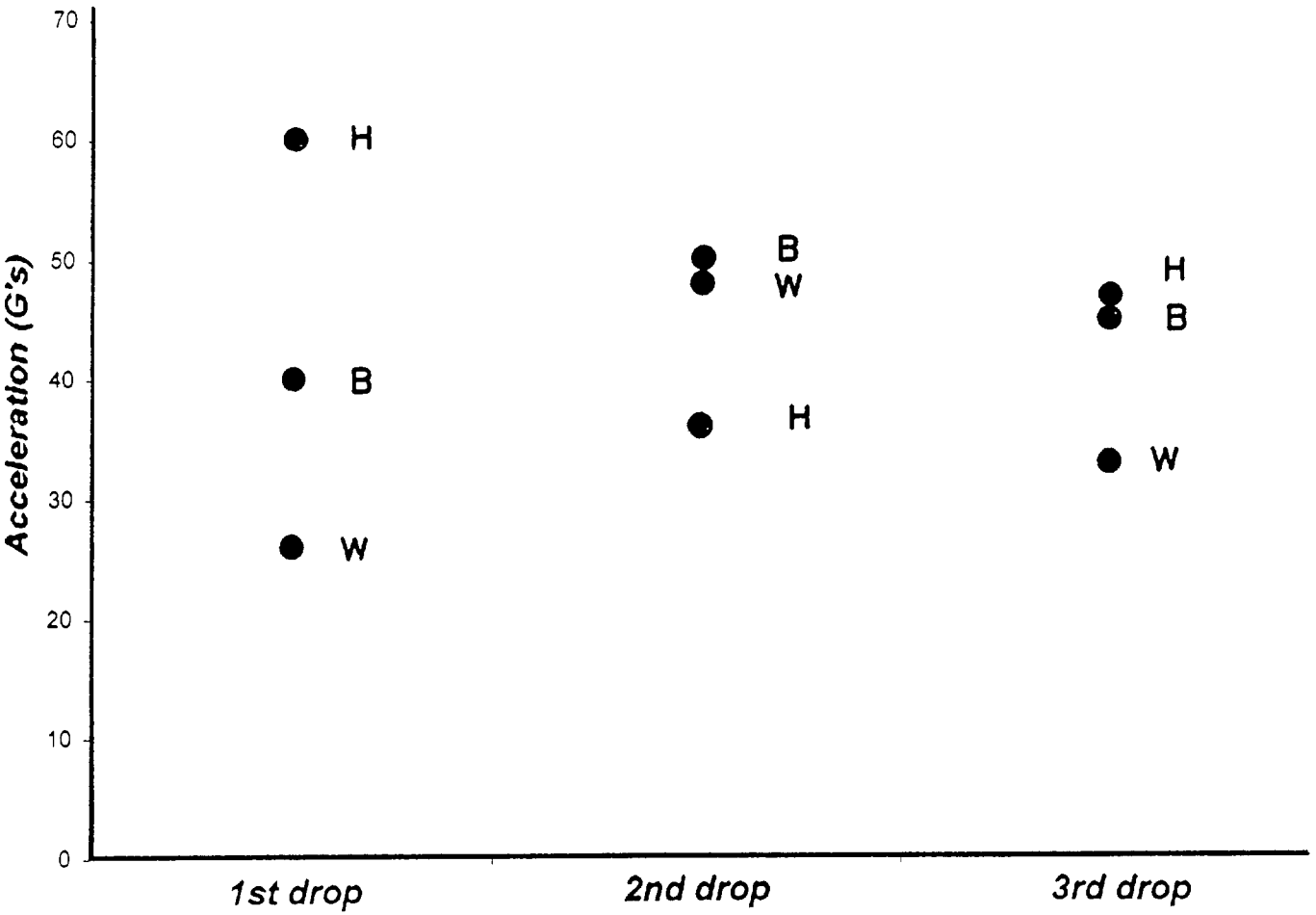
FIG. 20 is a graph of test results of a packing product constructed in accordance with the present invention.

Referring now to FIGS. 18-20, there are shown several plots, or graphs, of test data demonstrating the effects of various of the aforedescribed embodiments of packing products. FIG. 18 shows test results of a packing product similar to that shown in FIG. 5 except that the face sheets thereof are rectangular in shape. Four packing products were tested, their differences being in the free length (i.e., uncoiled length) of the coiled crumpled sheet pad sandwiched between the face sheets thereof. Each crumpled sheet pad was formed by converting 15 inch wide kraft paper into a four inch wide strip of crumpled sheet pad, the paper having a 30 pound basis weight. The strip was cut to form 120 cm, 150 cm, 180 cm, and 210 cm length crumpled sheet pads, which were then coiled. The face sheets in each test were the same size. Thus, greater length crumpled sheet pads were more densely wound than shorter length crumpled sheet pads. For example, the 210 cm length coiled crumpled sheet pad was more densely wound than the 120 cm length coiled crumpled sheet pad.

The x-axis of the graph represents the static load (measured in PSI) subjected to the packing product and the y-axis represents the acceleration or shock (measured in an average G) transmitted to the product through the packing product as a result of five sequential drops from a predetermined height, the average G being based on the $2^{nd}$, $3^{rd}$, $4^{th}$ and $5^{th}$ drops. As the graph in FIG. 18 indicates, the packing products exhibited substantially similar G's for static loads in the range of 0.05 PSI to 0.086 PSI. Thus, at lower static loads the packing products tend to perform similarly, exhibiting G's in the range of about 28 to about 36 at a static load of 0.05 PSI and about 34 to about 44 at a static load of 0.086 PSI. At higher static loads, for example, at static loads of 0.162 PSI, the packing products having more densely wound coiled crumpled sheet pads (e.g., 210 cm), tend to exhibit less G's than the packing products having less densely wound coiled crumpled sheet pads (e.g., 120 cm). Consequently, for greater static loads a packing product having a more densely wound coiled crumpled sheet pad will generally expose the article to be packaged to less shock than a packing product having a relatively less densely wound coiled crumpled sheet pad. Accordingly, the cushioning characteristics of a packing product can be varied by varying the length of the coiled crumpled sheet pad of the packing product and the density at which it is wound.

Similar test results were obtained for packing products having straight pads, i.e., linearly arranged crumpled sheet pads, such as the packing product shown in FIG. 2. The test results are shown in the graph of FIG. 19. Here, three packing products were tested, their differences being in the quantity of crumpled sheet pads sandwiched between the face sheets thereof. Like the crumpled sheet pads in the afore described test in FIG. 18, each crumpled sheet pad was formed by converting 15 inch wide kraft paper into a four inch wide strip of crumpled sheet pad, the paper having a 30 pound basis weight. The strip was cut to form 30 cm length crumpled sheet pads. The 30 cm length crumpled sheet pads were then stacked next to the other (i.e., aligned) with the lateral edge portions thereof being attached to the face sheets. The quantity of pads in each packing product tested were four, five and six, respectively. The face sheets in each test were the same size. Thus, the pads of the packing product having six pads were aligned closer together than the pads of the packing product having four pads.

As shown in the FIG. 19 graph, the test results of the packing products having aligned crumpled sheet pads does suggest that the quantity of crumpled sheet pads is proportional to the effectiveness of the packing product. The trend, or slope, of the curves shown in the graph suggests that all of the packing products (four, five or six pads aligned) exhibit, on average, increasing G's as the static load increases beyond 0.086 PSI. Thus, for example, at a static load of 0.086 PSI, 0.111 PSI and 0.162 PSI, the average G's are about, respectively, 35 G's, 48 G's and 85 G's. Thus, for the described static load range shown, packing products having four pads aligned, five pads aligned or six pads aligned exhibit greater G's with increases in static load. Consequently, all of the packing products (whether four, five or six pads aligned) will generally expose the article to be packaged to more shock as the static load transmitted to the product through the packing product is increased above the 0.086 level.

Referring again to FIG. 18, it will be appreciated that the overall trends, or slopes, of the curves shown in the graphs of FIGS. 18 and 19 show a similar trend except for the six aligned pads. For the packing products having coiled crumpled sheet pads, at static loads of 0.05 PSI, 0.061 PSI, 0.086 PSI, 0.111 PSI and 0.162 PSI, the average G's are about, respectively 32 G's, 35 G's, 39 G's, 53 G's and 65 G's. These values resemble the G values, transmitted to the products through the packing products, the latter having the crumpled sheet pads discussed above. Thus, the cushioning characteristics and the effectiveness of a packing product having a coiled crumpled sheet pad is similar though slightly lower than that of a packing product having aligned crumpled sheet pads.

FIG. 20 shows test results of three different packing products each tested, by a drop from a predetermined height, with a television receiver providing a static load of 0.164 PSI. Each packing product was dropped three times, in a bottom down orientation, as indicated along the x-axis as "$1^{st}$ drop", "$2^{nd}$ drop" and "$3^{rd}$ drop". The H data points in the graph represent test points corresponding to a packing product made of honeycomb material, the packing product being wrapped around the television receiver. The B data points in the graph represent test points corresponding to a packing product having a coiled crumpled sheet pad sandwiched between a pair of face sheets in accordance with the afore described FIG. 5 embodiment, the packing product being placed underneath the television receiver. The W data points in the graph represent test points corresponding to the afore described wrap around packing product, that is, the packing product shown in FIGS. 15 and 16, with the television receiver being supported on all sides thereof.

The test results shown in FIG. 20 indicate that the honeycomb packing product exhibited the largest G's (i.e., about 60) at the $1^{st}$ drop and the wrap around packing product exhibited the lowest G's (i.e., about 27). The B packing product exhibited about 40 G's at the $1^{st}$ drop. The substantial differences between the several packing products at the $1^{st}$ drop are at least partially attributed to the relative stiffness or ruggedness of the packing products. For example, since the honeycomb packing product is stiffer than either of the wrap around or the B packing products, it exhibits relatively larger G's. Consequently, for a $1^{st}$ drop a wrap around packing product according to the present invention exposes the article to be packaged to less shock than a honeycomb packing product.

At the $2^{nd}$ and $3^{rd}$ drops the honeycomb packing products become more resilient, that is, less stiff. As is shown in FIG. 20, the honeycomb packing product exhibits lower G's at both the $2^{nd}$ and the $3^{rd}$ drops. The B packing product and the wrap around packing product, on the other hand, being initially less rigid than the honeycomb packing product, become less resilient and thus exhibit higher G's at the $2^{nd}$ drop and then slightly lower G's at the $3^{rd}$ drop. The fluctuations in the values of the G's suggests that the packing products change further with each additional drop. The FIG. 20 graph shows that the wrap around packing product according to the present invention tends to perform better than the other packing products.

Figure 21:
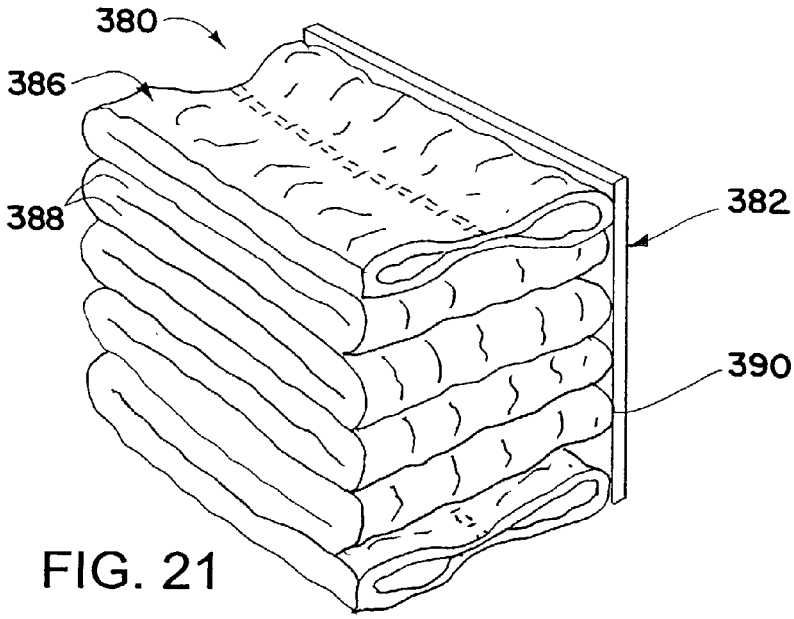
FIG. 21 is a perspective view of another packing product in accordance with the present invention.
Figure 22:
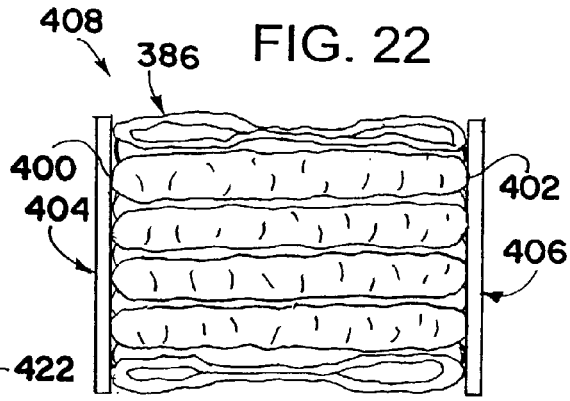
FIG. 22 is a side elevational view of a packing product in accordance with the present invention.

FIG. 21 shows yet another embodiment of a packing product 380 in accordance with the present invention. The packing product 380 includes a face sheet 382 and a crumpled sheet pad folded upon itself in an accordion-like manner to form a pad 386 of two or more stacked layers 388. One edge 390 of the pad 386 (the right edge shown in FIG. 21) is attached to the face sheet 382, although it will be appreciated that opposite edges 400 and 402 of the pad 386 may be attached to respective face sheets 404 and 406, as is shown in the packing product 408 of FIG. 22. By attaching the face sheet 382 to the edge 390 (FIG. 21), the face sheet 382 assists in maintaining the accordion-like form of the crumpled sheet pad 386 by preventing the folded pad 386 from expanding in the direction perpendicular to the accordion-like folds of the pad 386.

Figure 23:
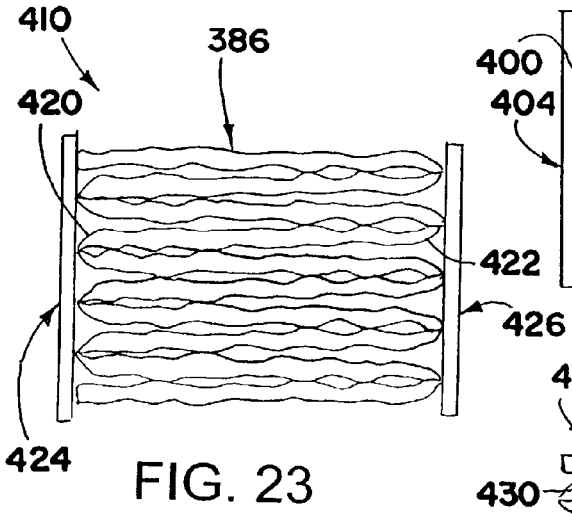
FIG. 23 is a side elevational view of a packing product in accordance with the present invention.
Figure 24:
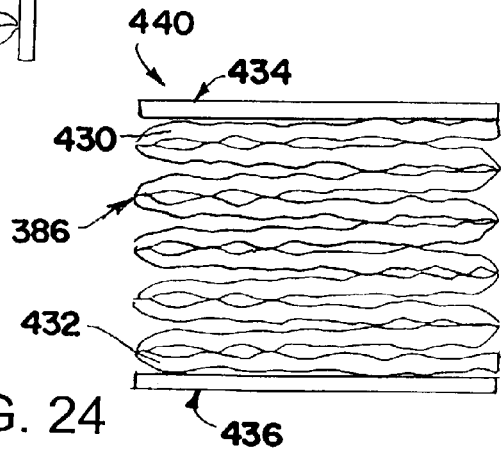
FIG. 24 is a side elevational view of a packing product in accordance with the present invention.

Alternatively, as shown in the packing product 410 of FIG. 23, folded edges 420 and 422 of the pad 386 may be attached to respective face sheets 424 and 426. Still another alternative is to attach the outermost layers 430 and 432 of the pad 386 to respective face sheets 434 and 436, as is shown in the packing product 440 of FIG. 24. In the FIG. 24 embodiment, the overlapping layers 430 and 432 may be pulled apart and/or pressed together as desired.

Figure 25:
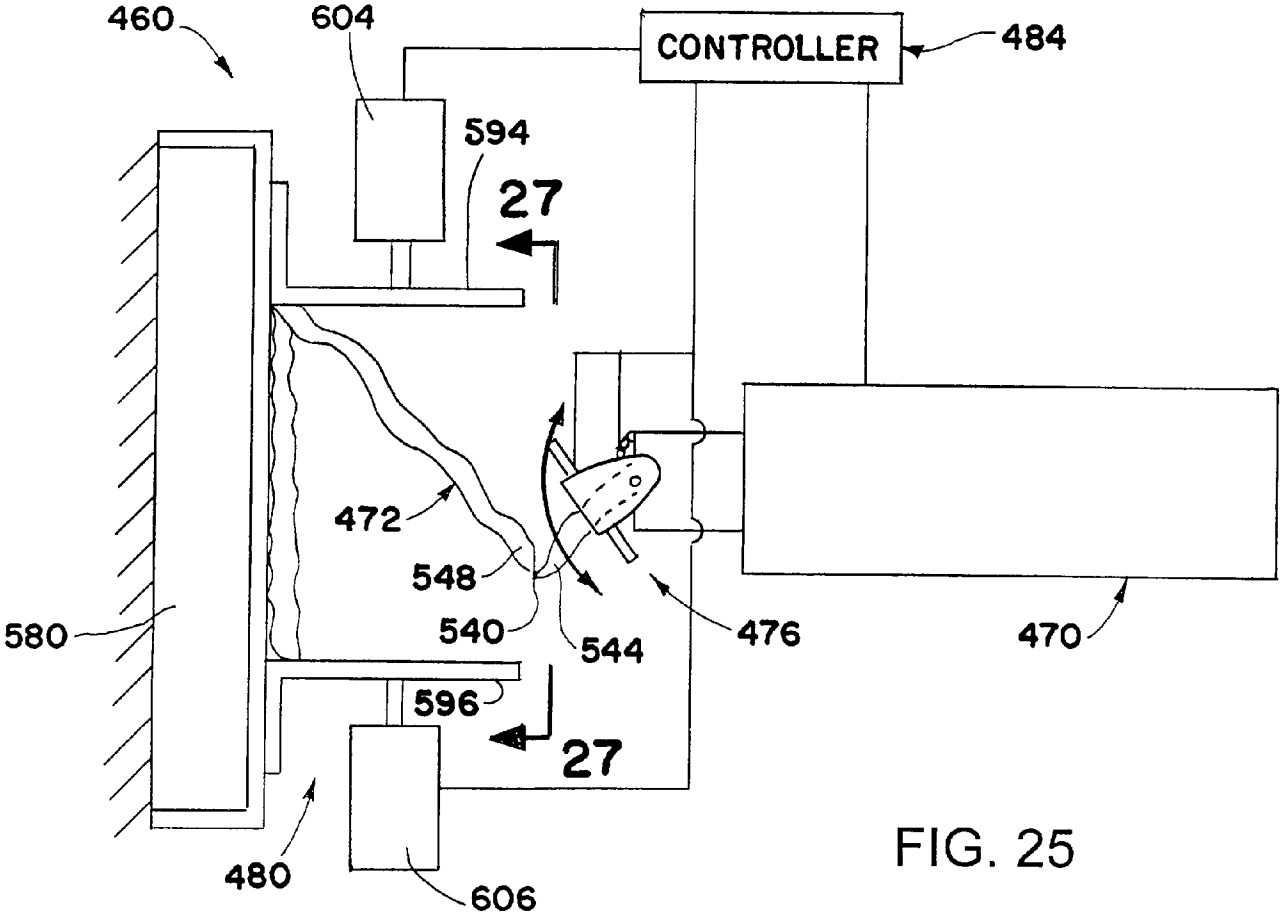
FIG. 25 is a side elevational view of a pad producing apparatus for forming a strip of dunnage for use as part of the packing product of FIGS. 21-24.

Referring now to FIG. 25, there is shown a pad producing apparatus 460 in accordance with the present invention. The pad producing apparatus 460 forms an accordion-like crumpled sheet pad for use in the accordion-like packing product of FIGS. 21-24. The pad producing apparatus 460 includes a dunnage supply machine 470 such as, for example, the above referenced cushioning conversion machine, for supplying a strip of dunnage 472, a folding device 476 for folding the strip of dunnage 472, and a capture chute 480 for guiding and accumulating layers of the strip of dunnage 472, the layers forming an accordion-like folded pad. In the illustrated embodiment, the pad producing apparatus 460 further includes a controller 484 for synchronizing the operation of the dunnage supply machine 470, the folding device 476 and capture chute 480.

Figure 26:
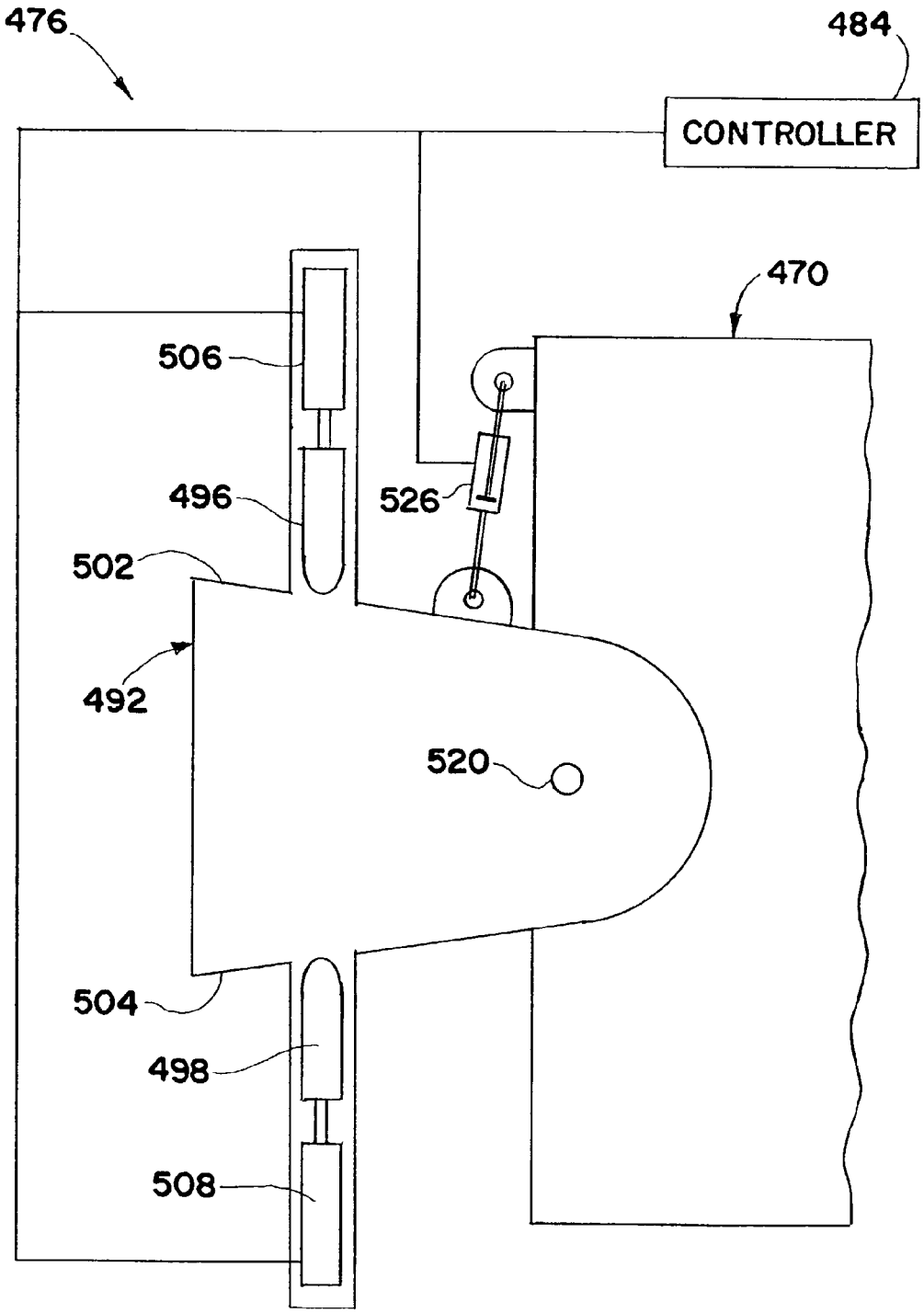
FIG. 26 is a side elevational view of a folding device of the pad producing apparatus of FIG. 25.

The folding device 476 is shown in greater detail in FIG. 26. The folding device 476 includes a swivelling chute 492 and opposed pinch or squeeze members 496 and 498 disposed, respectively, on opposite walls 502 and 504 of the swivelling chute 492, and thus on opposite sides of the path of travel of the strip of dunnage 472 (FIG. 25). The pinch members 496 and 498 are relatively moved towards one another and, therefore, towards the strip of dunnage 472 by suitable means such as one or more linear actuators 506 and 508. The swivelling chute 492 is moved about a pivot axis 520 by suitable means such as a linear actuator 526 to direct the strip of dunnage 472 in a desired location in the capture chute 480 (FIG. 25) to effect guiding and accumulating of the strip of dunnage, as is described in greater detail below.

In operation, the pinch members 496 and 498 are relatively moved towards one another to create a fold line 540 (FIG. 25) in, and transverse to the length of, the strip of dunnage 472, and the chute 492 is swivelled to direct a portion 544 of the strip of dunnage 472 upstream of the fold line 540 in a first direction (for example, at a downward angle). Referring again to FIG. 25, the dunnage supply machine machine 470 pushes the upstream portion 544 of the strip of dunnage 472 towards a portion 548 of the strip 472 downstream of the fold line 540. Since movement of the downstream portion 548 of the strip 472 is resisted by a wall of the capture chute 480, the pushing by the dunnage supply machine 470 bends the upstream portion 544 relative to the downstream portion 548 about the fold line 540 which, in turn, urges together in parallel relation the upstream and downstream portions 544 and 548. The pinch members 496 and 498 are relatively retracted from one another after creating a fold line. After a sufficient length strip of dunnage 472 is dispensed and folded to form a layer of the accordion-like pad, the pinch members 496 and 498 are again relatively moved towards one another to create a succeeding fold line (i.e., a fold line upstream from the earlier formed fold line)(not shown), and the chute 492 is swivelled to direct a portion of the strip of dunnage upstream of the succeeding fold line in a second direction (for example, at an upward angle)(not shown). The dunnage supply machine 470, in turn, urges together in parallel relation the portions of the strip of dunnage 472 upstream and downstream of the succeeding fold line. The dunnage supply machine 470 continues forming a strip of dunnage 472 and the opposed pinch members 496 and 498 continue alternating kinking or crimping, respectively, the strip of dunnage 472 as it is dispensed from the dunnage supply machine 470, until a desired amount of layers forming the accordion-like pad are obtained.

Figure 27:
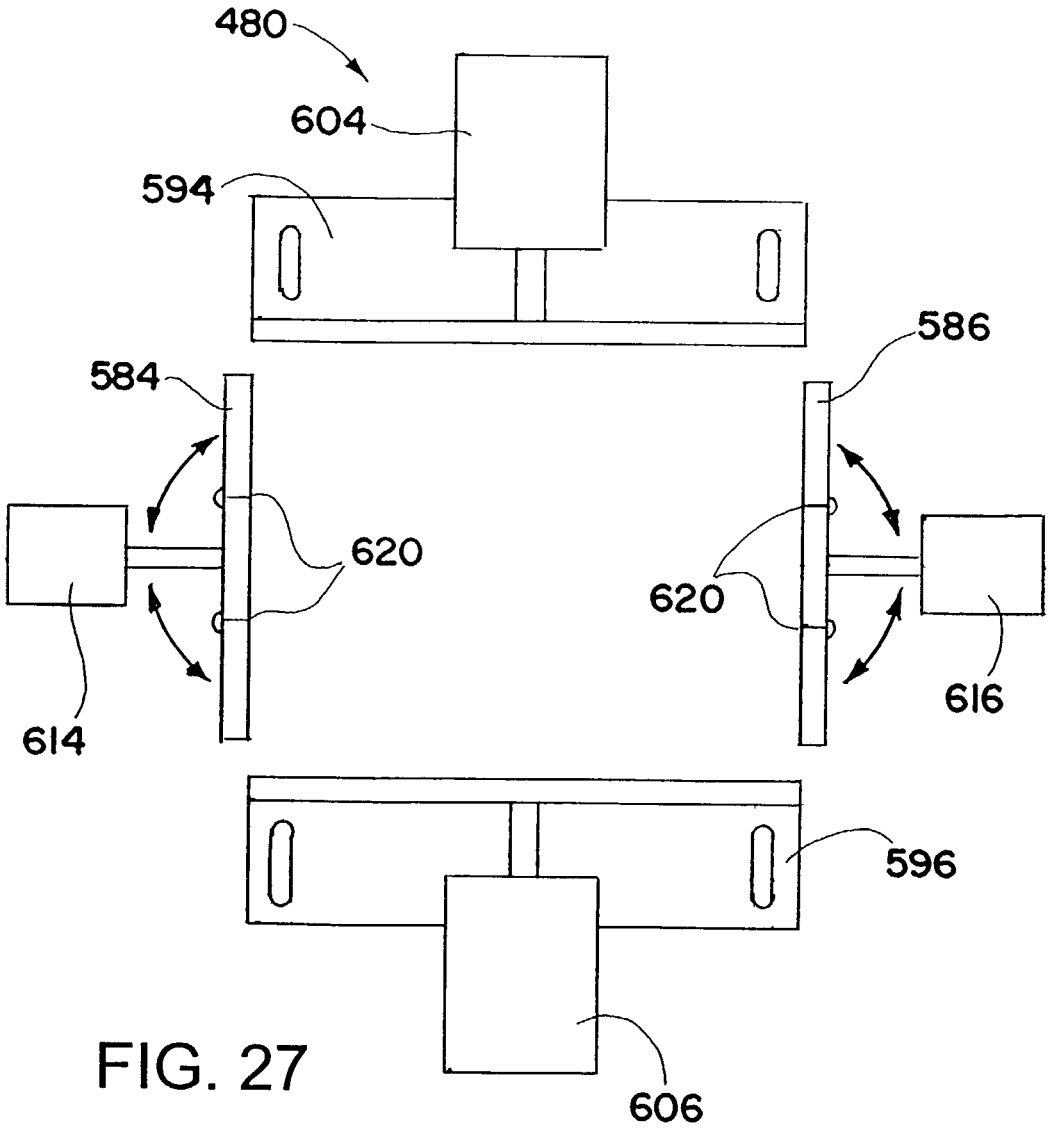
FIG. 27 is an end view of a capture chute of the pad producing apparatus of FIG. 25 as seen from the plane 27-27 in FIG. 25.

Referring now to FIGS. 25 and 27, the capture chute 480 into which the strip is dispensed includes a rear wall 580 (FIG. 25), a first pair of opposed walls 584 and 586 spaced apart to accommodate the width of the strip of dunnage 472, and a second pair of opposed walls 594 and 596 (perpendicular to opposed walls 584, 586, respectively) spaced apart to accommodate the length of the layers of the accordion-like folded pad. The walls 584, 586, 594 and 596 also have a depth sufficient to accommodate a desired amount of layers of accordion-like pad formed by the dunnage supply machine 470 and folding device 476. Also, the first pair of opposed walls 584 and 586 may assist the folding device 476 in folding in parallel relation the upstream and downstream portions of the strip of dunnage.

To facilitate accommodation of different length layers of pads, the capture chute 480 may include suitable means, such as a pair of respective actuators 604 and 606 on the opposed walls 594 and 596, to move the opposed walls 594 and 596 relative to one another to increase or decrease the spacing therebetween. Although a pair of actuators 604 and 606 is shown, a single actuator and a suitable linkage arrangement synchronizing the movements of the opposed walls 594 and 596 may be used in an alternative embodiment.

Similarly, the capture chute 480 may be adapted to accommodate different width pads. To this end, the capture chute 480 may include suitable means, such as a pair of respective actuators 614 and 616 on the opposed walls 584 and 586, to move the opposed walls 584 and 586 relative to one another to increase or decrease the spacing therebetween. It will be appreciated that the opposed walls 584 and 586 may be collapsible about hinge points 620, as shown in FIG. 27, in order to maintain a cooperative relationship between the opposed walls 584 and 586 and the opposed walls 594 and 596. Alternatively, the opposed walls 584 and 586 may be replaced as needed to accommodate a width according to the desired width of the pad.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A packing product comprising:

at least two face sheets, each face sheet having a length dimension; and at least one randomly crumpled sheet interposed between the at least two face sheets, the randomly crumpled sheet attached to each face sheet at random locations; wherein the at least one crumpled sheet extends substantially the entire length of at least one face sheet.

2. A packing product as set forth in claim 1, wherein the crumpled sheet includes at least one ply of a continuous sheet material folded on itself and crumpled.

3. A packing product as set forth in claim 1, wherein the at least one crumpled sheet in transverse cross section has a width greater than its height, and the at least one crumpled sheet has the width thereof disposed parallel to at least one face sheet.

4. A packing product as set forth in claim 1, wherein the at least one crumpled sheet in transverse cross section has a width greater than its height, and the at least one crumpled sheet has the width thereof disposed perpendicular to at least one face sheet.

5. A packing product as set forth in claim 1, wherein the at least one crumpled sheet includes a plurality of crumpled sheets, each of which has a length dimension and the plurality of crumpled sheets are oriented with their length dimensions generally parallel to one another.

6. A packing product as set forth in claim 1, wherein at least one face sheet includes an outer face sheet and a plurality of inner face sheets; and wherein the at least one crumpled sheet includes a plurality of crumpled sheets sandwiched between and attached to the outer face sheet and the respective plurality of inner face sheets.

7. A packing product as set forth in claim 1, wherein at least one face sheet includes an opening for receiving an article therein.

8. A method of making the packing product of claim 1, comprising the step of attaching the at least one crumpled sheet to the at least two face sheets.

9. A method of packaging an article comprising:

attaching a plurality of randomly crumpled sheets to respective plurality of outer face sheet walls;

attaching a plurality of inner face sheets to the respective plurality of crumpled sheets;

positioning the article on at least one of the inner face sheets;

folding the plurality of outer face sheet walls inwardly towards the article so that the inner face sheets align with the respective sides of the article; and securing the plurality of outer face sheet walls to maintain the outer face sheet walls in their folded states.

10. A packaging product produced by the process comprising the steps of: randomly crumpling a stock material; and then combining the crumpled stock material with at least one face sheet; wherein the step of combining the crumpled stock material with the at least one face sheet includes bringing the crumpled stock material together with the at least one face sheet such that at least one laterally outer edge of the face sheet extends beyond a respective laterally outer edge of the crumpled stock material.

11. A packaging product produced by the process of claim 10, further comprising folding the face sheet about an axis and connecting at least a portion of opposing edge portions together to form a pouch.

* * * * *